US010937441B1

(12) United States Patent
Kristjansson et al.

(10) Patent No.: US 10,937,441 B1
(45) Date of Patent: Mar. 2, 2021

(54) BEAM LEVEL BASED ADAPTIVE TARGET SELECTION

(71) Applicant: Amazon Technologies, Inc., Seattle, WA (US)

(72) Inventors: Trausti Thor Kristjansson, San Jose, CA (US); Xianxian Zhang, Santa Clara, CA (US); Philip Ryan Hilmes, Sunnyvale, CA (US)

(73) Assignee: Amazon Technologies, Inc., Seattle, WA (US)

( * ) Notice: Subject to any disclaimer, the term of this patent is extended or adjusted under 35 U.S.C. 154(b) by 122 days.

(21) Appl. No.: 16/240,577

(22) Filed: Jan. 4, 2019

(51) Int. Cl.

| | |
|---|---|
| ***G10L 21/0232*** | (2013.01) |
| ***G10L 21/0264*** | (2013.01) |
| ***G10L 21/0364*** | (2013.01) |
| ***G10L 21/0216*** | (2013.01) |
| ***G10L 21/0208*** | (2013.01) |

(52) U.S. Cl.
CPC ..... *G10L 21/0232* (2013.01); *G10L 21/0264* (2013.01); *G10L 21/0364* (2013.01); *G10L 2021/02082* (2013.01); *G10L 2021/02163* (2013.01)

(58) Field of Classification Search
CPC ..... G10L 21/0232; G10L 21/0364; G10L 21/0208; G10L 2021/02082; G10L 2021/02166; G10L 25/78; G10L 2025/783; H04B 3/234; H04R 3/00; H04R 3/005; H04R 2201/401; H04R 240/01; H04R 2430/20
See application file for complete search history.

(56) References Cited

U.S. PATENT DOCUMENTS

| | | | | |
|---|---|---|---|---|
| 8,320,554 | B1 * | 11/2012 | Chu | H04M 9/082 379/406.08 |
| 10,032,475 | B2 * | 7/2018 | Prins | G10H 1/0033 |
| 10,115,411 | B1 * | 10/2018 | Chu | G10L 21/0364 |
| 10,122,863 | B2 * | 11/2018 | Zargar | H04B 3/21 |
| 10,154,148 | B1 * | 12/2018 | Chu | H04M 3/002 |
| 10,388,298 | B1 * | 8/2019 | Gopalan | H04B 3/466 |
| 10,622,009 | B1 * | 4/2020 | Zhang | H04R 3/00 |
| 2010/0030558 | A1 * | 2/2010 | Herbig | G10L 25/78 704/240 |
| 2012/0250852 | A1 * | 10/2012 | Rowley | H04M 9/082 379/406.01 |
| 2014/0278381 | A1 * | 9/2014 | Dehghani | G10L 21/0388 704/206 |

(Continued)

*Primary Examiner* — Yogeshkumar Patel
(74) *Attorney, Agent, or Firm* — Pierce Atwood LLP

(57) ABSTRACT

A system configured to improve audio processing by adaptively selecting target signals based on current system conditions. For example, a device may select a target signal based on a highest signal quality metric when only the local speech is present (e.g., during near-end single-talk conditions), as this maximizes an amount of energy included in the output audio signal. In contrast, the device may select the target signal based on a lowest signal quality metric when only the remote speech is present (e.g., during far-end single-talk conditions), as this minimizes an amount of energy included in the output audio signal. In addition, the device may track positions of the local speech and the remote speech over time, enabling the device to accurately select the target signal when both local speech and remote speech is present (e.g., during double-talk conditions).

20 Claims, 20 Drawing Sheets

(56) References Cited

U.S. PATENT DOCUMENTS

2014/0334620 A1* 11/2014 Yemdji ..... H04R 3/02
379/406.08
2014/0335917 A1* 11/2014 Tetelbaum ..... H04M 9/082
455/570

* cited by examiner

Dynamic Reference Beam Selection During Far-End Single-Talk

Dynamic Reference Beam Selection During Near-End Single-Talk

Freezing Reference Beam Selection During Near-End Single-Talk

FIG. 9A

| Peaks | Decision |
|---|---|
| 0 | Silence |
| 1 | Single-Talk |
| 2 | Double-Talk |

Decision Chart
910

FIG. 9B

| | Decision | |
|---|---|---|
| Peaks | No Far-End Speech | Far-End Speech |
| 0 | Silence | Silence |
| 1 | Near-End Single-Talk | Far-End Single-Talk |
| 2 | Multiple Near-End Single-Talk | Double-Talk |

Additional Context Data
922

Decision Chart
920

BEAM LEVEL BASED ADAPTIVE TARGET SELECTION

BACKGROUND

With the advancement of technology, the use and popularity of electronic devices has increased considerably. Electronic devices are commonly used to capture and process audio data.

BRIEF DESCRIPTION OF DRAWINGS

For a more complete understanding of the present disclosure, reference is now made to the following description taken in conjunction with the accompanying drawings.

FIGS. 9A-9B illustrate examples of determining system conditions according to examples of the present disclosure.

DETAILED DESCRIPTION

Electronic devices may be used to capture and process audio data. The audio data may be used for voice commands and/or may be output by loudspeakers as part of a communication session. During a communication session, loudspeakers may generate audio using playback audio data while a microphone generates local audio data. An electronic device may perform audio processing, such as acoustic echo cancellation, residual echo suppression, and/or the like, to remove an "echo" signal corresponding to the playback audio data from the local audio data, isolating local speech to be used for voice commands and/or the communication session.

The device may apply different settings for audio processing based on current system conditions (e.g., whether local speech and/or remote speech is present in the local audio data). For example, when local speech is present and remote speech is not present in the local audio data (e.g., "near-end single-talk"), the device may use light audio processing to pass any speech included in the local audio data without distortion or degrading the speech. When remote speech and local speech are both present in the local audio data (e.g., "double-talk"), the device may use medium audio processing to suppress unwanted additional signals while passing speech included in the local audio data with minor distortion or degradation. However, when remote speech is present and local speech is not present in the local audio data (e.g., "far-end single-talk"), the device may use aggressive audio processing to suppress the unwanted additional signals included in the local audio data.

To improve audio processing based on current system conditions, devices, systems and methods are disclosed that adaptively select target signals based on the current system conditions. For example, a device may select a target signal based on a highest signal quality metric when only the local speech is present (e.g., during near-end single-talk conditions), as this maximizes an amount of energy included in the output audio signal. In contrast, the device may select the target signal based on a lowest signal quality metric when only the remote speech is present (e.g., during far-end single-talk conditions), as this minimizes an amount of energy included in the output audio signal. In addition, the device may track positions of the local speech and the remote speech over time, enabling the device to accurately select the target signal when both local speech and remote speech is present (e.g., during double-talk conditions). Thus, during the double-talk conditions the device may select the target signal based on a highest signal quality metric, a previously selected target signal (e.g., from when only local speech was present), historical positions of the local speech and the remote speech, and/or the like without departing from the disclosure.

Figure 1:
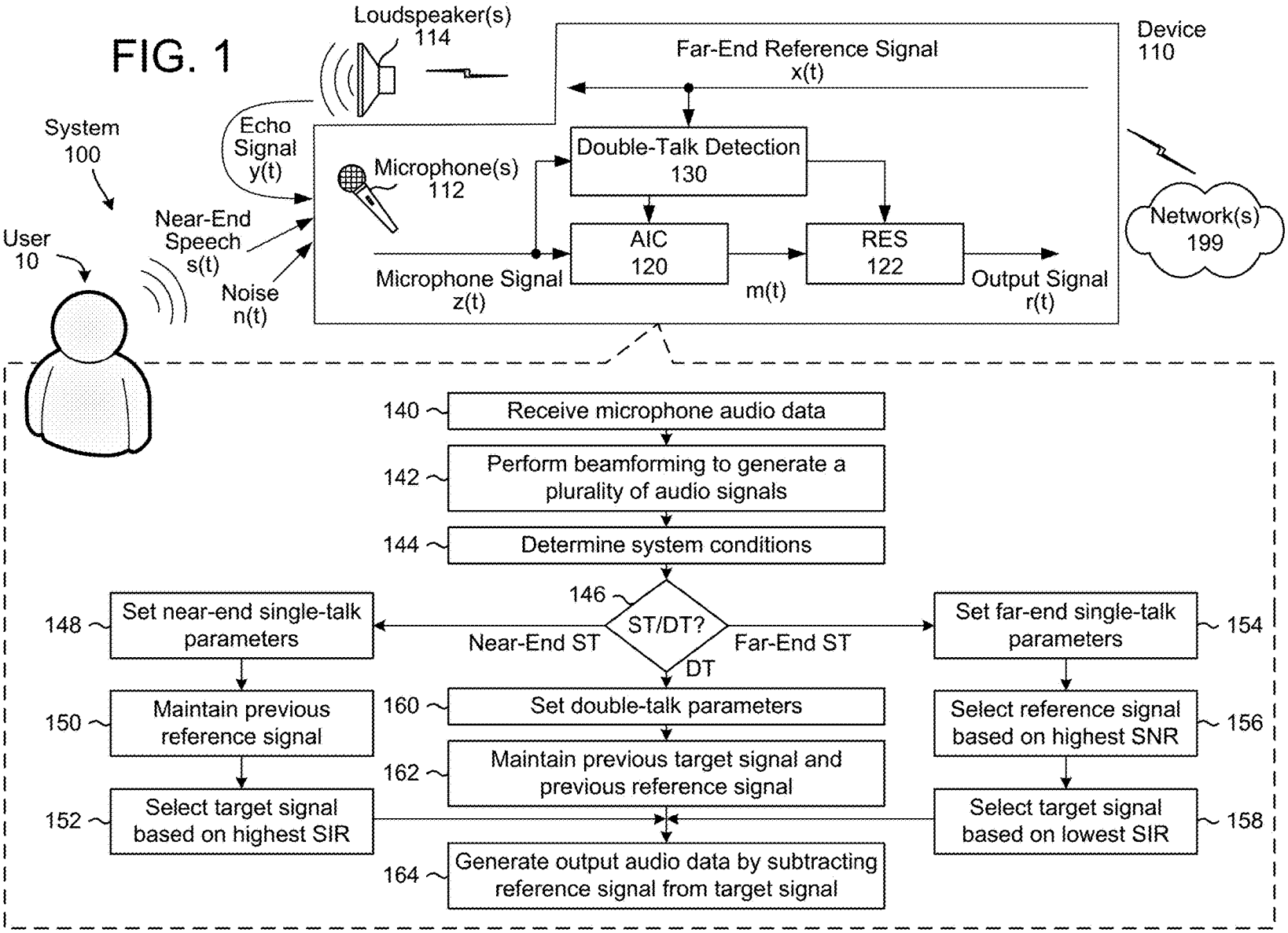
FIG. 1 illustrates a system according to embodiments of the present disclosure.

FIG. 1 illustrates a high-level conceptual block diagram of a system 100 configured to perform echo cancellation based on current system conditions. Although FIG. 1, and other figures/discussion illustrate the operation of the system in a particular order, the steps described may be performed in a different order (as well as certain steps removed or added) without departing from the intent of the disclosure. As illustrated in FIG. 1, the system 100 may include a device 110 that may be communicatively coupled to network(s) 199 and may include one or more microphone(s) 112 in a microphone array and/or one or more loudspeaker(s) 114. However, the disclosure is not limited thereto and the device 110 may include additional components without departing from the disclosure.

To emphasize that the double-talk detection is beneficial when variable delays are present, FIG. 1 illustrates the one or more loudspeaker(s) 114 as being external to the device 110 and connected to the device 110 wirelessly. However, the disclosure is not limited thereto and the loudspeaker(s) 114 may be included in the device 110 and/or connected via a wired connection without departing from the disclosure. For example, the loudspeaker(s) 114 may correspond to a wireless loudspeaker, a television, an audio system, and/or the like connected to the device 110 using a wireless and/or wired connection without departing from the disclosure.

In some examples, the loudspeaker(s) 114 may be internal to the device 110 without departing from the disclosure. Typically, generating output audio using only an internal loudspeaker corresponds to a fixed delay and therefore the device 110 may detect system conditions using other double-talk detection algorithms. However, when the loudspeaker is internal to the device 110, the device 110 may perform the techniques described herein in place of and/or in addition to the other double-talk detection algorithms to improve a result of the double-talk detection. For example, as will be described in greater detail below, the double-talk detection component 130 may be configured to determine location(s) associated with a target signal (e.g., near-end or local speech) and/or a reference signal (e.g., far-end or remote speech, music, and/or other audible noises output by the loudspeaker(s) 114). Therefore, while a location of the internal loudspeaker may be known, the device 110 may use the double-talk detection component 130 to determine location(s) associated with one or more near-end talkers (e.g., user 10).

The device 110 may be an electronic device configured to send audio data to and/or receive audio data. For example, the device 110 (e.g., local device) may receive playback audio data (e.g., far-end reference audio data) from a remote device and the playback audio data may include remote speech originating at the remote device. During a communication session, the device 110 may generate output audio corresponding to the playback audio data using the one or more loudspeaker(s) 114. While generating the output audio, the device 110 may capture microphone audio data (e.g., input audio data) using the one or more microphone(s) 112. In addition to capturing desired speech (e.g., the microphone audio data includes a representation of local speech from a user 10), the device 110 may capture a portion of the output audio generated by the loudspeaker(s) 114 (including a portion of the remote speech), which may be referred to as an "echo" or echo signal, along with additional acoustic noise (e.g., undesired speech, ambient acoustic noise in an environment around the device 110, etc.), as discussed in greater detail below.

The system 100 may operate differently based on whether local speech (e.g., near-end speech) and/or remote speech (e.g., far-end speech) is present in the microphone audio data. For example, when the local speech is detected in the microphone audio data, the device 110 may apply first parameters to improve an audio quality associated with the local speech, without attenuating or degrading the local speech. In contrast, when the local speech is not detected in the microphone audio data, the device 110 may apply second parameters to attenuate the echo signal and/or noise.

As will be discussed in greater detail below, the device 110 may include a double-talk detection component 130 (e.g., single-talk (ST)/double-talk (DT) detector) that determines current system conditions. For example, the double-talk detection component 130 may determine that neither local speech nor remote speech are detected in the microphone audio data, which corresponds to no-speech conditions. In some examples, the double-talk detection component 130 may determine that local speech is detected but remote speech is not detected in the microphone audio data, which corresponds to near-end single-talk conditions (e.g., local speech only). Alternatively, the double-talk detection component 130 may determine that remote speech is detected but local speech is not detected in the microphone audio data, which corresponds to far-end single-talk conditions (e.g., remote speech only). Finally, the double-talk detection component 130 may determine that both local speech and remote speech is detected in the microphone audio data, which corresponds to double-talk conditions (e.g., local speech and remote speech). While the examples described below refer to the device 110 determining system conditions using the double-talk detection component 130, this component may be referred to as a ST/DT detection component without departing from the disclosure.

Typically, conventional double-talk detection components know whether the remote speech is present based on whether the remote speech is present in the playback audio data. When the remote speech is present in the playback audio data, the echo signal is often represented in the microphone audio data after a consistent echo latency. Thus, the conventional double-talk detection components may estimate the echo latency by taking a cross-correlation between the playback audio data and the microphone audio data, with peaks in the cross-correlation data corresponding to portions of the microphone audio data that include the echo signal (e.g., remote speech). Therefore, the conventional double-talk detection components may determine that remote speech is detected in the microphone audio data and distinguish between far-end single-talk conditions and double-talk conditions by determining whether the local speech is also present. While the conventional double-talk detection components may determine that local speech is present using many techniques known to one of skill in the art, in some examples the conventional double-talk detection components may compare peak value(s) from the cross-correlation data to threshold values to determine current system conditions. For example, low peak values may indicate near-end single-talk conditions (e.g., no remote speech present due to low correlation between the playback audio data and the microphone audio data), high peak values may indicate far-end single-talk conditions (e.g., no local speech present due to high correlation between the playback audio data and the microphone audio data), and middle peak values may indicate double-talk conditions (e.g., both local speech and remote speech present, resulting in medium correlation between the playback audio data and the microphone audio data).

While the conventional double-talk detection components may accurately detect current system conditions, calculating the cross-correlation results in latency or delays. More importantly, when using wireless loudspeaker(s) 114 and/or when there are variable delays in outputting the playback audio data, performing the cross-correlation may require an extremely long analysis window (e.g., up to and exceeding 700 ms) to detect the echo latency, which is hard to predict and may vary. This long analysis window for finding the peak of the correlation requires not only a large memory but also increases a processing requirement (e.g., computation cost) for performing double-talk detection.

To improve double-talk detection, the double-talk detection component 130 illustrated in FIG. 1 may include two or more detectors and/or algorithms and may determine current system conditions based on a combination of outputs from these detectors. As will be described in greater detail below with regard to FIG. 8A, the double-talk detection component 130 may include a first detector that is configured to receive a portion of the microphone signal z(t) corresponding to two microphones 112 and generate decision data. For example, the double-talk detection component 130 may include a least mean squares (LMS) adaptive filter that performs acoustic interference cancellation (AIC) processing using a first microphone signal as a target signal and a second microphone signal as a reference signal. To avoid confusion with the adaptive filter associated with the AIC component 120, the adaptive filter associated with the double-talk detection component 130 may be referred to as a least mean squares (LMS) adaptive filter, and corresponding filter coefficient values may be referred to as LMS filter coefficient data. Based on the LMS filter coefficient data of the LMS adaptive filter, the double-talk detection component 130 may determine if near-end single-talk conditions, far-end single-talk conditions, or double-talk conditions are present. For example, the double-talk detection component 130 may distinguish between single-talk conditions and double-talk conditions based on a number of peaks represented in the LMS filter coefficient data. Thus, a single peak corresponds to single-talk conditions, whereas two or more peaks may correspond to double-talk conditions.

In some examples, the double-talk detection component 130 may only update the LMS filter coefficients for the LMS adaptive filter when a meaningful signal is detected. For example, the device 110 will not update the LMS filter coefficients when speech is not detected in the microphone signal z(t). The device 110 may use various techniques to determine whether audio data includes speech, including performing voice activity detection (VAD) techniques using a VAD detector. When the VAD detector detects speech in the microphone audio data, the device 110 performs double-talk detection on the microphone audio data and/or updates the LMS filter coefficients of the LMS adaptive filter.

In addition to the first detector (e.g., LMS adaptive filter), the double-talk detection component 130 may include a second detector that is configured to receive a portion of the microphone signal z(t) as well as the far-end reference signal x(t) and determine whether near-end speech is present in the microphone signal z(t). When far-end speech is not present, the double-talk detection component 130 may determine that near-end single-talk conditions are present. However, when the far-end speech is present in the microphone signal z(t), the double-talk detection component 130 may distinguish between far-end single-talk conditions (e.g., a single peak represented in the LMS filter coefficient data) and double-talk conditions (e.g., two or more peaks represented in the LMS filter coefficient data) based on the LMS filter coefficient data.

The double-talk detection component 130 may generate decision data that indicates current system conditions (e.g., near-end single-talk conditions, far-end single-talk conditions, or double-talk conditions). In some examples, the decision data may include location data indicating a location (e.g., direction relative to the device 110) associated with each of the peaks represented in the LMS filter coefficient data. For example, individual filter coefficients of the LMS adaptive filter may correspond to a time of arrival of the audible sound, enabling the device 110 to determine the direction of an audio source relative to the device 110. Thus, the double-talk detection component 130 may generate decision data that indicates the current system conditions, a number of peak(s) represented in the LMS filter coefficient data, and/or the location(s) of the peak(s) without departing from the disclosure.

As illustrated in FIG. 1, the device 110 may receive (140) microphone audio data from the microphone(s) 112 (e.g., two or more microphones 112), may perform (142) beamforming to generate a plurality of audio signals corresponding to a plurality of directions (e.g., first audio signal corresponding to a first direction, second audio signal corresponding to a second direction, etc.), and may determine (144) system conditions. For example, the device 110 may input the microphone signal z(t) and/or the far-end reference signal x(t) into the double-talk detection component 130 and determine the current system conditions (e.g., near-end single-talk, far-end single-talk, or double-talk conditions).

The device 110 may determine (146) whether current system conditions correspond to near-end single-talk, far-end single-talk, or double-talk conditions. If the current system conditions correspond to near-end single-talk conditions, the device 110 may set (148) near-end single-talk parameters (e.g., first parameters), as discussed above with regard to FIG. 2, and may maintain (150) a previous reference signal. For example, the device 110 may have previously selected one or more audio signals as the reference signal during far-end single-talk conditions, and the device 110 may continue using the one or more audio signals as the reference signal in step 150. As used herein, "a reference signal" is used to refer to any number of audio signals and/or portions of audio data and is not limited to a single audio signal associated with a single direction. Thus, the reference signal may correspond to a combination of the first audio signal and the second audio signal without departing from the disclosure.

Based on the reference signal selected in step 150, the device 110 may select (152) a target signal based on a highest signal quality metric value (e.g., signal-to-interference ratio (SIR) value, signal-to-noise ratio (SNR) value, and/or the like) from the remaining audio signals of the plurality of audio signals that are not associated with the reference signal. For example, if the reference signal corresponds to a combination of the first audio signal and the second audio signal, the device 110 may determine an SIR value for each of the remaining audio signals in the plurality of audio signals. The SIR value may be calculated by dividing a first value (e.g., energy value, loudness value, root means square (RMS) value, and/or the like) associated with an individual non-reference audio signal by a second value associated with the reference signal (e.g., combination of the first audio signal and the second audio signal). For example, the device 110 may determine a first SIR value associated with a third audio signal by dividing a first value associated with the third audio signal by a second value associated with the first audio signal and the second audio signal. Similarly, the device 110 may determine a second SIR value associated with a fourth audio signal by dividing a third value associated with the fourth audio signal by the second value associated with the first audio signal and the second audio signal. The device 110 may then compare the SIR values to determine a highest SIR value and may select a corresponding audio signal as the target signal. Thus, if the first SIR value is greater than the second SIR value and any other SIR values associated with the plurality of audio signals, the device 110 may select the third audio signal as the target signal.

To determine the SIR value, the device 110 may determine a first plurality of energy values corresponding to individual frequency bands of the reference signals (e.g., first audio signal and the second audio signal) and may generate a first energy value as a weighted sum of the first plurality of energy values. The device 110 may then determine a second plurality of energy values corresponding to individual frequency bands of the third audio signal and generate a second energy value as a weighted sum of the second plurality of energy values. Thus, the first energy value corresponds to the reference signals and the second energy value corresponds to the third audio signal. The device 110 may then determine the SIR value associated with the third audio signal by dividing the second energy value by the first energy value.

While FIG. 1 illustrates that the device 110 selects the target signal based on a highest/lowest SIR value, this is intended for illustrative purposes only and the disclosure is not limited thereto. When near-end single-talk conditions and/or double-talk conditions are present, the device 110 may select the target signal having a highest energy value (e.g., step 152), whereas when far-end single-talk conditions are present the device 110 may select the target signal having a lowest energy value (e.g., step 158). Thus, while SIR values are an example of a signal quality metric indicating an energy value, the disclosure is not limited thereto and the device 110 may select the target signal based on the SIR value, a signal-to-noise ratio (SNR) value, other energy values and/or the like without departing from the disclosure. Similarly, the device 110 may select the reference signal in step 156 based on any signal quality metric without departing from the disclosure.

While FIG. 1 illustrates that the device 110 selects the target signal based on a highest SIR value, this is intended for illustrative purposes only and the disclosure is not limited to selecting a single audio signal as the target signal. Instead, the device 110 may select two or more audio signals as the target signal based on two or more highest SIR values without departing from the disclosure.

If the current system conditions correspond to far-end single-talk conditions, the device 110 may set (154) far-end single-talk parameters (e.g., second parameters), as discussed above with regard to FIG. 2, and may select (156) a reference signal based on a highest signal quality metric (e.g., signal to noise ratio (SNR) value, average power value, and/or the like). For example, the device 110 may determine a signal quality metric value for each of the plurality of audio signals and may select one or more of the plurality of audio signals associated with one or more of the highest signal quality metric values as the reference signal.

Based on the reference signal selected in step 156, the device 110 may select (158) a target signal based on a lowest signal quality metric value (e.g., signal-to-interference ratio (SIR) value) from the remaining audio signals of the plurality of audio signals that are not associated with the reference signal. For example, if the reference signal corresponds to a combination of the first audio signal and the second audio signal, the device 110 may determine an SIR value for each of the remaining audio signals in the plurality of audio signals. The SIR values may be calculated as described above with regard to step 152.

If the current system conditions correspond to double-talk conditions, the device 110 may set (160) double-talk parameters (e.g., third parameters), as discussed above with regard to FIG. 2, and may maintain (162) a previous target signal and a previous reference signal. For example, the device 110 may determine the target signal selected most recently during near-end single-talk conditions and may determine the reference signal selected most recently during far-end single-talk conditions. However, the disclosure is not limited thereto and the device 110 may select the target signal based on a highest signal quality metric, as described above with regard to step 152, without departing from the disclosure.

Whether the current system conditions correspond to near-end single-talk conditions, far-end single-talk conditions, or double-talk conditions, the device 110 may generate (164) output audio data by subtracting the reference signal from the target signal. For example, the device 110 may perform AIC by subtracting one or more first audio signals associated with the reference signal from one or more second audio signals associated with the target signal.

While not illustrated in FIG. 1, the device 110 may apply appropriate smoothing, history buffering, and/or the like to minimize distortion caused by switching the target signal from a first target signal having a highest SIR value to a second target signal having a lowest SIR value and vice versa. Thus, the device 110 may apply additional processing when transitioning from far-end single-talk parameters to near-end single-talk parameters and/or double-talk parameters, as well as when transitioning from near-end single-talk parameters and/or double-talk parameters to far-end single-talk parameters. The device 110 may use any techniques known to one of skill in the art to avoid distortion when switching between target signals.

While FIG. 1 and other examples illustrate the device 110 performing beamforming to generate a plurality of audio signals, and therefore the device 110 selects target signals and/or reference signals from the beamformed audio data, the disclosure is not limited thereto. Instead, the device 110 may select target signals and/or reference signals from the microphone audio data without performing beamforming. For example, a first microphone may be positioned in proximity to the loudspeaker(s) 114 or other sources of acoustic noise while a second microphone may be positioned in proximity to the user 10. Thus, the device 110 may select first microphone audio data associated with the first microphone as the reference signal and may select second microphone audio data associated with the second microphone as the target signal without departing from the disclosure. Additionally or alternatively, the device 110 may select the target signals and/or the reference signals from a combination of the beamformed audio data and the microphone audio data without departing from the disclosure.

While the above description provided a summary of how to perform double-talk detection using speech detection models, the following paragraphs will describe FIG. 1 in greater detail.

For ease of illustration, some audio data may be referred to as a signal, such as a far-end reference signal x(t), an echo signal y(t), an echo estimate signal y'(t), a microphone signal z(t), error signal m(t) or the like. However, the signals may be comprised of audio data and may be referred to as audio data (e.g., far-end reference audio data x(t), echo audio data y(t), echo estimate audio data y'(t), microphone audio data z(t), error audio data m(t)) without departing from the disclosure.

During a communication session, the device 110 may receive a far-end reference signal x(t) (e.g., playback audio data) from a remote device/remote server(s) via the network(s) 199 and may generate output audio (e.g., playback audio) based on the far-end reference signal x(t) using the one or more loudspeaker(s) 114. Using one or more microphone(s) 112 in the microphone array, the device 110 may capture input audio as microphone signal z(t) (e.g., near-end reference audio data, input audio data, microphone audio data, etc.) and may send the microphone signal z(t) to the remote device/remote server(s) via the network(s) 199.

In some examples, the device 110 may send the microphone signal z(t) to the remote device as part of a Voice over Internet Protocol (VoW) communication session. For example, the device 110 may send the microphone signal z(t) to the remote device either directly or via remote server(s) and may receive the far-end reference signal x(t)

from the remote device either directly or via the remote server(s). However, the disclosure is not limited thereto and in some examples, the device 110 may send the microphone signal z(t) to the remote server(s) in order for the remote server(s) to determine a voice command. For example, during a communication session the device 110 may receive the far-end reference signal x(t) from the remote device and may generate the output audio based on the far-end reference signal x(t). However, the microphone signal z(t) may be separate from the communication session and may include a voice command directed to the remote server(s). Therefore, the device 110 may send the microphone signal z(t) to the remote server(s) and the remote server(s) may determine a voice command represented in the microphone signal z(t) and may perform an action corresponding to the voice command (e.g., execute a command, send an instruction to the device 110 and/or other devices to execute the command, etc.). In some examples, to determine the voice command the remote server(s) may perform Automatic Speech Recognition (ASR) processing, Natural Language Understanding (NLU) processing and/or command processing. The voice commands may control the device 110, audio devices (e.g., play music over loudspeaker(s) 114, capture audio using microphone(s) 112, or the like), multimedia devices (e.g., play videos using a display, such as a television, computer, tablet or the like), smart home devices (e.g., change temperature controls, turn on/off lights, lock/unlock doors, etc.) or the like.

The device 110 may operate using a microphone array 114 comprising multiple microphones, where beamforming techniques may be used to isolate desired audio including speech. In audio systems, beamforming refers to techniques that are used to isolate audio from a particular direction in a multi-directional audio capture system. Beamforming may be particularly useful when filtering out noise from non-desired directions. Beamforming may be used for various tasks, including isolating voice commands to be executed by a speech-processing system.

One technique for beamforming involves boosting audio received from a desired direction while dampening audio received from a non-desired direction. In one example of a beamformer system, a fixed beamformer unit employs a filter-and-sum structure to boost an audio signal that originates from the desired direction (sometimes referred to as the look-direction) while largely attenuating audio signals that original from other directions. A fixed beamformer unit may effectively eliminate certain diffuse noise (e.g., undesireable audio), which is detectable in similar energies from various directions, but may be less effective in eliminating noise emanating from a single source in a particular non-desired direction. The beamformer unit may also incorporate an adaptive beamformer unit/noise canceller that can adaptively cancel noise from different directions depending on audio conditions.

In audio systems, acoustic echo cancellation (AEC) processing refers to techniques that are used to recognize when a device has recaptured sound via microphone(s) after some delay that the device previously output via loudspeaker(s). The device may perform AEC processing by subtracting a delayed version of the original audio signal (e.g., far-end reference signal x(t)) from the captured audio (e.g., microphone signal z(t)), producing a version of the captured audio that ideally eliminates the "echo" of the original audio signal, leaving only new audio information. For example, if someone were singing karaoke into a microphone while prerecorded music is output by a loudspeaker, AEC processing can be used to remove any of the recorded music from the audio captured by the microphone, allowing the singer's voice to be amplified and output without also reproducing a delayed "echo" of the original music. As another example, a media player that accepts voice commands via a microphone can use AEC processing to remove reproduced sounds corresponding to output media that are captured by the microphone, making it easier to process input voice commands.

As an alternative to generating the reference signal based on the playback audio data, Adaptive Reference Algorithm (ARA) processing may generate an adaptive reference signal based on the input audio data. To illustrate an example, the ARA processing may perform beamforming using the input audio data to generate a plurality of audio signals (e.g., beamformed audio data) corresponding to particular directions. For example, the plurality of audio signals may include a first audio signal corresponding to a first direction, a second audio signal corresponding to a second direction, a third audio signal corresponding to a third direction, and so on. The ARA processing may select the first audio signal as a target signal (e.g., the first audio signal includes a representation of speech) and the second audio signal as a reference signal (e.g., the second audio signal includes a representation of the echo and/or other acoustic noise) and may perform Adaptive Interference Cancellation (AIC) (e.g., adaptive acoustic interference cancellation) by removing the reference signal from the target signal. As the input audio data is not limited to the echo signal, the ARA processing may remove other acoustic noise represented in the input audio data in addition to removing the echo. Therefore, the ARA processing may be referred to as performing AIC, adaptive noise cancellation (ANC), AEC, and/or the like without departing from the disclosure.

As discussed in greater detail below, the device 110 may be configured to perform AIC using the ARA processing to isolate the speech in the input audio data. The device 110 may dynamically select target signal(s) and/or reference signal(s). Thus, the target signal(s) and/or the reference signal(s) may be continually changing over time based on speech, acoustic noise(s), ambient noise(s), and/or the like in an environment around the device 110. In some examples, the device 110 may select the target signal(s) based on signal quality metrics (e.g., signal-to-interference ratio (SIR) values, signal-to-noise ratio (SNR) values, average power values, etc.) differently based on current system conditions. For example, the device 110 may select target signal(s) having highest signal quality metrics during near-end single-talk conditions (e.g., to increase an amount of energy included in the target signal(s)), but select the target signal(s) having lowest signal quality metrics during far-end single-talk conditions (e.g., to decrease an amount of energy included in the target signal(s)).

Additionally or alternatively, the device 110 may select the target signal(s) by detecting speech, based on signal strength values or signal quality metrics (e.g., signal-to-noise ratio (SNR) values, average power values, etc.), and/or using other techniques or inputs, although the disclosure is not limited thereto. As an example of other techniques or inputs, the device 110 may capture video data corresponding to the input audio data, analyze the video data using computer vision processing (e.g., facial recognition, object recognition, or the like) to determine that a user is associated with a first direction, and select the target signal(s) by selecting the first audio signal corresponding to the first direction. Similarly, the adaptive beamformer may identify the reference signal(s) based on the signal strength values and/or using other inputs without departing from the disclosure. Thus, the target signal(s) and/or the reference signal(s) selected by the adaptive beamformer may vary, resulting in different filter coefficient values over time.

As discussed above, the device 110 may perform beamforming (e.g., perform a beamforming operation to generate beamformed audio data corresponding to individual directions). As used herein, beamforming (e.g., performing a beamforming operation) corresponds to generating a plurality of directional audio signals (e.g., beamformed audio data) corresponding to individual directions relative to the microphone array. For example, the beamforming operation may individually filter input audio signals generated by multiple microphones in the microphone array 114 (e.g., first audio data associated with a first microphone, second audio data associated with a second microphone, etc.) in order to separate audio data associated with different directions. Thus, first beamformed audio data corresponds to audio data associated with a first direction, second beamformed audio data corresponds to audio data associated with a second direction, and so on. In some examples, the device 110 may generate the beamformed audio data by boosting an audio signal originating from the desired direction (e.g., look direction) while attenuating audio signals that originate from other directions, although the disclosure is not limited thereto.

To perform the beamforming operation, the device 110 may apply directional calculations to the input audio signals. In some examples, the device 110 may perform the directional calculations by applying filters to the input audio signals using filter coefficients associated with specific directions. For example, the device 110 may perform a first directional calculation by applying first filter coefficients to the input audio signals to generate the first beamformed audio data and may perform a second directional calculation by applying second filter coefficients to the input audio signals to generate the second beamformed audio data.

The filter coefficients used to perform the beamforming operation may be calculated offline (e.g., preconfigured ahead of time) and stored in the device 110. For example, the device 110 may store filter coefficients associated with hundreds of different directional calculations (e.g., hundreds of specific directions) and may select the desired filter coefficients for a particular beamforming operation at runtime (e.g., during the beamforming operation). To illustrate an example, at a first time the device 110 may perform a first beamforming operation to divide input audio data into 36 different portions, with each portion associated with a specific direction (e.g., 10 degrees out of 360 degrees) relative to the device 110. At a second time, however, the device 110 may perform a second beamforming operation to divide input audio data into 6 different portions, with each portion associated with a specific direction (e.g., 60 degrees out of 360 degrees) relative to the device 110.

These directional calculations may sometimes be referred to as "beams" by one of skill in the art, with a first directional calculation (e.g., first filter coefficients) being referred to as a "first beam" corresponding to the first direction, the second directional calculation (e.g., second filter coefficients) being referred to as a "second beam" corresponding to the second direction, and so on. Thus, the device 110 stores hundreds of "beams" (e.g., directional calculations and associated filter coefficients) and uses the "beams" to perform a beamforming operation and generate a plurality of beamformed audio signals. However, "beams" may also refer to the output of the beamforming operation (e.g., plurality of beamformed audio signals). Thus, a first beam may correspond to first beamformed audio data associated with the first direction (e.g., portions of the input audio signals corresponding to the first direction), a second beam may correspond to second beamformed audio data associated with the second direction (e.g., portions of the input audio signals corresponding to the second direction), and so on. For ease of explanation, as used herein "beams" refer to the beamformed audio signals that are generated by the beamforming operation. Therefore, a first beam corresponds to first audio data associated with a first direction, whereas a first directional calculation corresponds to the first filter coefficients used to generate the first beam.

Prior to sending the microphone signal z(t) to the remote device/remote server(s), the device 110 may perform acoustic echo cancellation (AEC), adaptive interference cancellation (AIC), residual echo suppression (RES), and/or other audio processing to isolate local speech captured by the microphone(s) 112 and/or to suppress unwanted audio data (e.g., echoes and/or noise). As illustrated in FIG. 1, the device 110 may receive the far-end reference signal x(t) (e.g., playback audio data) and may generate playback audio (e.g., echo signal y(t)) using the loudspeaker(s) 114. The far-end reference signal x(t) may be referred to as a far-end reference signal (e.g., far-end reference audio data), a playback signal (e.g., playback audio data) or the like. The one or more microphone(s) 112 in the microphone array may capture a microphone signal z(t) (e.g., microphone audio data, near-end reference signal, input audio data, etc.), which may include the echo signal y(t) along with near-end speech s(t) from the user 10 and noise n(t).

To isolate the local speech (e.g., near-end speech s(t) from the user 10), the device 110 may include an AIC component 120 that selects target signal(s) and reference signal(s) from the beamformed audio data and generates an error signal m(t) by removing the reference signal(s) from the target signal(s). As the AIC component 120 does not have access to the echo signal y(t) itself, the reference signal(s) are selected as an approximation of the echo signal y(t). Thus, when the AIC component 120 removes the reference signal(s) from the target signal(s), the AIC component 120 is removing at least a portion of the echo signal y(t). In addition, the reference signal(s) may include the noise n(t) and other acoustic interference. Therefore, the output (e.g., error signal m(t)) of the AIC component 120 may include the near-end speech s(t) along with portions of the echo signal y(t) and/or the noise n(t) (e.g., difference between the reference signal(s) and the actual echo signal y(t) and noise n(t)).

To improve the audio data, in some examples the device 110 may include a residual echo suppressor (RES) component 122 to dynamically suppress unwanted audio data (e.g., the portions of the echo signal y(t) and the noise n(t) that were not removed by the AIC component 120). For example, when the far-end reference signal x(t) is active and the near-end speech s(t) is not present in the error signal m(t), the RES component 122 may attenuate the error signal m(t) to generate final output audio data r(t). This removes and/or reduces the unwanted audio data from the final output audio data r(t). However, when near-end speech s(t) is present in the error signal m(t), the RES component 122 may act as a pass-through filter and pass the error signal m(t) without attenuation. This avoids attenuating the near-end speech s(t).

Residual echo suppression (RES) processing is performed by selectively attenuating, based on individual frequency bands, first audio data output by the AIC component 120 to generate second audio data output by the RES component. For example, performing RES processing may determine a gain for a portion of the first audio data corresponding to a specific frequency band (e.g., 100 Hz to 200 Hz) and may attenuate the portion of the first audio data based on the gain to generate a portion of the second audio data corresponding to the specific frequency band. Thus, a gain may be determined for each frequency band and therefore the amount of attenuation may vary based on the frequency band.

The device 110 may determine the gain based on the attenuation value. For example, a low attenuation value $\alpha_1$ (e.g., closer to a value of zero) results in a gain that is closer to a value of one and therefore an amount of attenuation is relatively low. Thus, the RES component 122 acts similar to a pass-through filter for the low frequency bands. An energy level of the second audio data is therefore similar to an energy level of the first audio data. In contrast, a high attenuation value $\alpha_2$ (e.g., closer to a value of one) results in a gain that is closer to a value of zero and therefore an amount of attenuation is relatively high. Thus, the RES component 122 attenuates the high frequency bands, such that an energy level of the second audio data is lower than an energy level of the first audio data. Therefore, the energy level of the second audio data corresponding to the high frequency bands is lower than the energy level of the second audio data corresponding to the low frequency bands.

In some examples, during near-end single-talk conditions (e.g., when the far-end speech is not present), the RES component 122 may act as a pass through filter and pass the error signal m(t) without attenuation. That includes when the near-end speech is not present, which is referred to as "no-talk" or no-speech conditions, and when the near-end speech is present, which is referred to as "near-end single-talk." Thus, the RES component 122 may determine a gain with which to attenuate the error signal m(t) using a first attenuation value ($\alpha_1$) for both low frequencies and high frequencies. In contrast, when the far-end speech is present and the near-end speech is not present, which is referred to as "far-end single-talk," the RES component 122 may act as an attenuator and may attenuate the error signal m(t) based on a gain calculated using a second attenuation value ($\alpha_2$) for low frequencies and high frequencies. For ease of illustration, the first attenuation value $\alpha_1$ may be referred to as a "low attenuation value" and may be smaller (e.g., closer to a value of zero) than the second attenuation value $\alpha_2$. Similarly, the second attenuation value $\alpha_2$ may be referred to as a "high attenuation value" and may be larger (e.g., closer to a value of one) than the first attenuation value $\alpha_1$. However, the disclosure is not limited thereto and in some examples the first attenuation value $\alpha_1$ may be higher than the second attenuation value $\alpha_2$ without departing from the disclosure.

When the near-end speech is present and the far-end speech is present, "double-talk" occurs. During double-talk conditions, the RES component 122 may pass low frequencies of the error signal m(t) while attenuating high frequencies of the error signal m(t). For example, the RES component 122 may determine a gain with which to attenuate the error signal m(t) using the low attenuation value ($\alpha_1$) for low frequencies and the high attenuation value ($\alpha_2$) for high frequencies.

An audio signal is a representation of sound and an electronic representation of an audio signal may be referred to as audio data, which may be analog and/or digital without departing from the disclosure. For ease of illustration, the disclosure may refer to either audio data (e.g., far-end reference audio data or playback audio data, microphone audio data, near-end reference data or input audio data, etc.) or audio signals (e.g., playback signal, far-end reference signal, microphone signal, near-end reference signal, etc.) without departing from the disclosure. Additionally or alternatively, portions of a signal may be referenced as a portion of the signal or as a separate signal and/or portions of audio data may be referenced as a portion of the audio data or as separate audio data. For example, a first audio signal may correspond to a first period of time (e.g., 30 seconds) and a portion of the first audio signal corresponding to a second period of time (e.g., 1 second) may be referred to as a first portion of the first audio signal or as a second audio signal without departing from the disclosure. Similarly, first audio data may correspond to the first period of time (e.g., 30 seconds) and a portion of the first audio data corresponding to the second period of time (e.g., 1 second) may be referred to as a first portion of the first audio data or second audio data without departing from the disclosure. Audio signals and audio data may be used interchangeably, as well; a first audio signal may correspond to the first period of time (e.g., 30 seconds) and a portion of the first audio signal corresponding to a second period of time (e.g., 1 second) may be referred to as first audio data without departing from the disclosure.

As used herein, audio signals or audio data (e.g., far-end reference audio data, near-end reference audio data, microphone audio data, or the like) may correspond to a specific range of frequency bands. For example, far-end reference audio data and/or near-end reference audio data may correspond to a human hearing range (e.g., 20 Hz-20 kHz), although the disclosure is not limited thereto.

Far-end reference audio data (e.g., far-end reference signal x(t)) corresponds to audio data that will be output by the loudspeaker(s) 114 to generate playback audio (e.g., echo signal y(t)). For example, the device 110 may stream music or output speech associated with a communication session (e.g., audio or video telecommunication). In some examples, the far-end reference audio data may be referred to as playback audio data, loudspeaker audio data, and/or the like without departing from the disclosure. For ease of illustration, the following description will refer to the playback audio data as far-end reference audio data. As noted above, the far-end reference audio data may be referred to as far-end reference signal(s) x(t) without departing from the disclosure.

Microphone audio data corresponds to audio data that is captured by the microphone(s) 114 prior to the device 110 performing audio processing such as AIC processing. The microphone audio data may include local speech s(t) (e.g., an utterance, such as near-end speech generated by the user 10), an "echo" signal y(t) (e.g., portion of the playback audio captured by the microphone(s) 114), acoustic noise n(t) (e.g., ambient noise in an environment around the device 110), and/or the like. As the microphone audio data is captured by the microphone(s) 114 and captures audio input to the device 110, the microphone audio data may be referred to as input audio data, near-end audio data, and/or the like without departing from the disclosure. For ease of illustration, the following description will refer to microphone audio data and near-end reference audio data interchangeably. As noted above, the near-end reference audio data/microphone audio data may be referred to as a near-end reference signal or microphone signal z(t) without departing from the disclosure.

An "echo" signal y(t) corresponds to a portion of the playback audio that reaches the microphone(s) 114 (e.g., portion of audible sound(s) output by the loudspeaker(s) 114 that is recaptured by the microphone(s) 112) and may be referred to as an echo or echo data y(t).

Output audio data corresponds to audio data after the device 110 performs audio processing (e.g., AIC processing, ANC processing, AEC processing, and/or the like) to isolate the local speech s(t). For example, the output audio data r(t) corresponds to the microphone audio data z(t) after subtracting the reference signal(s) (e.g., using adaptive interference cancellation (AIC) component 120), optionally performing residual echo suppression (RES) (e.g., using the RES component 122), and/or other audio processing known to one of skill in the art. As noted above, the output audio data may be referred to as output audio signal(s) without departing from the disclosure, and one of skill in the art will recognize that the output audio data may also be referred to as an error audio data m(t), error signal m(t) and/or the like.

For ease of illustration, the following description may refer to generating the output audio data by performing AIC processing and RES processing. However, the disclosure is not limited thereto, and the device 110 may generate the output audio data by performing AIC processing, RES processing, other audio processing, and/or a combination thereof. Additionally or alternatively, the disclosure is not limited to AIC processing and, in addition to or instead of performing AIC processing, the device 110 may perform other processing to remove or reduce unwanted speech $s_2(t)$ (e.g., speech associated with a second user), unwanted acoustic noise n(t), and/or echo signals y(t), such as acoustic echo cancellation (AEC) processing, adaptive noise cancellation (ANC) processing, and/or the like without departing from the disclosure.

Figure 2:
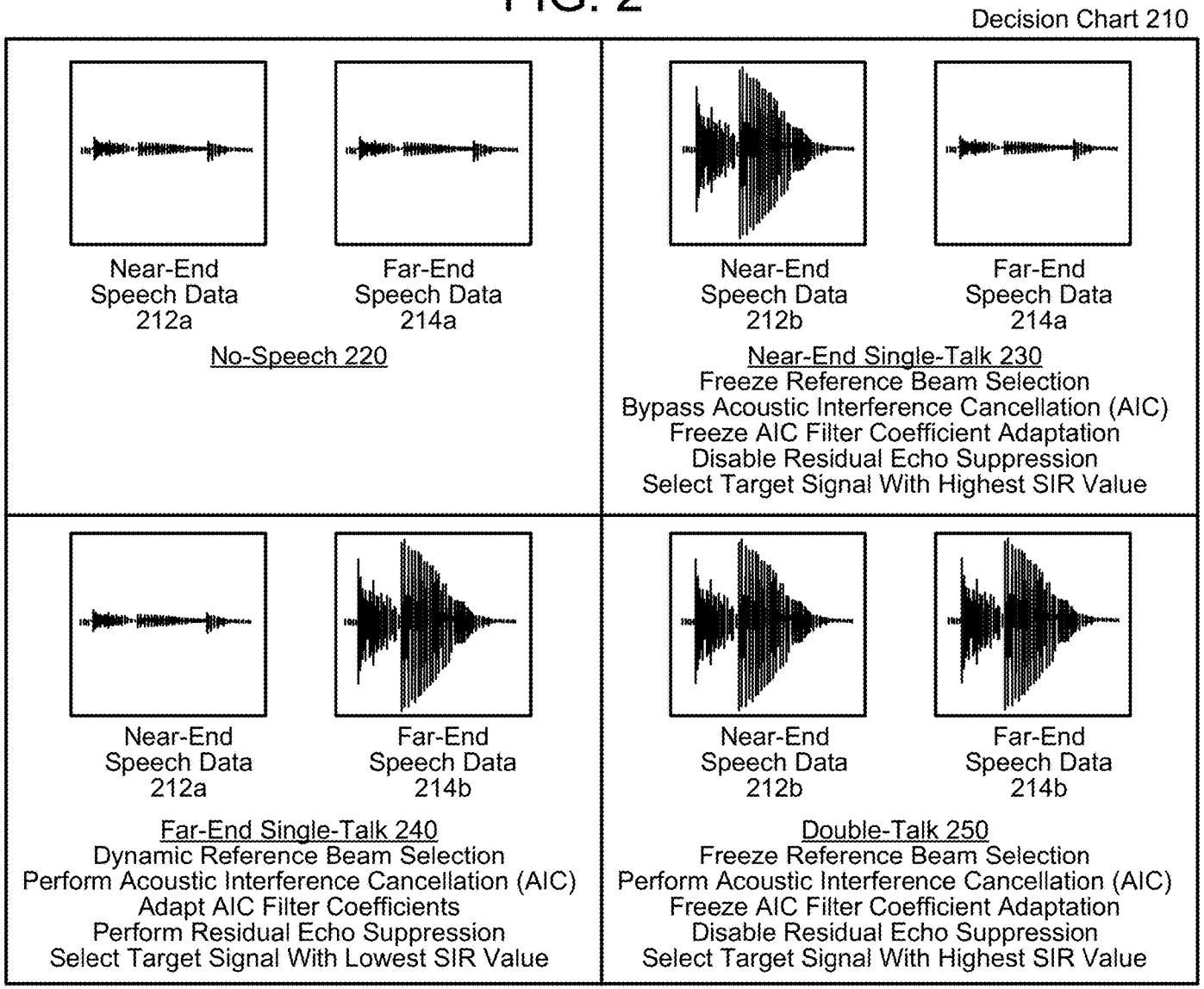
FIG. 2 illustrates an example decision chart for varying parameters based on system conditions according to examples of the present disclosure.

FIG. 2 illustrates an example decision chart for varying parameters based on system conditions according to examples of the present disclosure. As illustrated in decision chart 210, the device 110 may distinguish between different system conditions. For example, the device 110 may determine whether no-speech conditions 220 are present (e.g., no near-end speech and no far-end speech, represented by near-end speech data 212*a* and far-end speech data 214*a*), near-end single-talk conditions 230 are present (e.g., near-end speech but no far-end speech, represented by near-end speech data 212*b* and far-end speech data 214*a*), far-end single-talk conditions 240 are present (e.g., far-end speech but no near-end speech, represented by near-end speech data 212*a* and far-end speech data 214*b*), or double-talk conditions 250 are present (e.g., near-end speech and far-end speech, represented by near-end speech data 212*b* and far-end speech data 214*b*).

The device 110 may select parameters based on whether near-end speech is detected. For example, when far-end speech is detected and near-end speech is not detected (e.g., during far-end single-talk conditions 240), the device 110 may select parameters to reduce and/or suppress echo signals represented in the output audio data. As illustrated in FIG. 2, this may include performing dynamic reference beam selection, performing adaptive interference cancellation (AIC) using an adaptive filter, adapting AIC filter coefficients for the adaptive filter, performing RES processing and/or selecting a target signal based on a lowest signal quality metric (e.g., to reduce an amount of energy included in the target signal).

In contrast, when near-end speech is detected (e.g., during near-end single-talk conditions 230 and/or double-talk conditions 250), the device 110 may select parameters to improve a quality of the speech in the output audio data (e.g., avoid cancelling and/or suppressing the near-end speech). As illustrated in FIG. 2, this may include freezing (e.g., disabling) reference beam selection, bypassing AIC processing (e.g., during near-end single talk conditions 230) or performing AIC cancellation using existing AIC filter coefficients (e.g., during double-talk conditions 250), freezing (e.g., disabling) AIC filter coefficient adaptation for the adaptive filter, disabling RES processing, and/or selecting a target signal based on a highest signal quality metric (e.g., to increase an amount of energy included in the target signal). While FIG. 2 illustrates that the device 110 may select the target signal based on a highest signal quality metric during double-talk conditions 250, the disclosure is not limited thereto and in some examples the device 110 may maintain a previously selected target signal instead. Thus, the device 110 may only select the target signal during near-end single-talk conditions 230 and when double-talk conditions 250 are present, the device 110 may deter to the most recently selected target signal.

Dynamic reference beam selection, which will be described in greater detail below with regard to FIGS. 5A-5C, refers to adaptively selecting a reference beam based on which beamformed audio data has a highest energy. For example, the device 110 may dynamically select the reference beam based on which beamformed audio data has the largest amplitude and/or highest power, thus selecting the loudest beam as a reference beam to be removed during noise cancellation. During far-end single-talk conditions, this works well as the loudspeaker(s) 114 generating output audio based on the far-end reference signal are louder than other sources of noise and therefore Adaptive Reference Algorithm (ARA) processing selects the beamformed audio data associated with the loudspeaker(s) 114 as a reference signal. Thus, the adaptive interference cancellation (AIC) component 120 removes the acoustic noise and corresponding echo from the output audio data. However, during near-end single-talk conditions and/or double-talk conditions, the near-end speech may be louder than the loudspeaker(s) 114 and therefore the ARA processing may incorrectly select the beamformed audio data associated with the near-end speech as a reference signal. Thus, instead of removing noise and/or echo and isolating the local speech, the AIC component 120 would inadvertently remove portions of the local speech. Therefore, freezing (e.g., disabling) reference beam selection during near-end single-talk conditions 230 and/or double-talk conditions 250 ensures that the reference beam is selected only during far-end single-talk conditions 240 and corresponds to the loudspeaker(s) 114.

Similarly, the device 110 may adapt filter coefficients associated with the AIC component 120 during far-end single-talk conditions but may freeze (e.g., disable) filter coefficient adaptation during near-end single-talk conditions 230 and double-talk conditions 250. For example, in order to remove an echo associated with the far-end reference signal, the device 110 adapts the filter coefficients during far-end single-talk conditions 240 to minimize an "error signal" m(t) (e.g., output of the AIC component). However, the error signal m(t) should not be minimized during near-end single-talk conditions 230 and/or double-talk conditions 250, as the output of the AIC component 120 includes the local speech. Therefore, because continuing to adapt the filter coefficients during near-end single-talk conditions and/or double-talk conditions would result in the AIC component 120 adapting to the local speech, the device 110 freezes filter coefficient adaptation during these system conditions. Freezing filter coefficient adaptation refers to the device 110 disabling filter coefficient adaptation, such as by storing current filter coefficient values and using the stored filter coefficient values until filter coefficient adaptation is enabled again. Once filter coefficient adaptation is enabled (e.g., unfrozen), the device 110 dynamically adapts the filter coefficient values.

During double-talk conditions 250, the device 110 may perform AIC processing using the frozen AIC filter coefficients (e.g., filter coefficient values stored at the end of the most recent far-end single-talk conditions 240). Thus, the AIC component 120 may use the frozen AIC filter coefficients to remove portions of the echo signal y(t) and/or the noise n(t) while leaving the local speech s(t). However, during near-end single-talk conditions 230, the device 110 may bypass AIC processing entirely. As there is no far-end speech being output by the loudspeaker(s) 114, the device 110 does not need to perform the AIC processing as the microphone audio signal z(t) does not include the echo signal y(t). In addition, as the reference signals may capture a portion of the local speech s(t), performing the AIC processing may remove portions of the local speech s(t) from the error signal m(t). Therefore, bypassing the AIC processing ensures that the local speech s(t) is not distorted or suppressed inadvertently by the AIC component 120.

Finally, residual echo suppression (RES) processing further attenuates or suppresses audio data output by the AIC component 122. During far-end single-talk conditions, this audio data only includes noise and/or far-end speech, and therefore performing RES processing improves the audio data output by the device 110 during a communication session. However, during near-end single-talk conditions and/or double-talk conditions, this audio data may include local speech, and therefore performing RES processing attenuates at least portions of the local speech and degrades the audio data output by the device 110 during the communication session. Therefore, the device 110 may enable RES processing and/or apply aggressive RES processing during far-end single-talk conditions (e.g., to suppress unwanted noise and echo), but may disable RES and/or apply slight RES during near-end single-talk conditions and double-talk conditions (e.g., to improve a quality of the local speech).

As illustrated in FIG. 2, the device 110 does not set specific parameters during no speech conditions 220. As there is no far-end speech or near-end speech, output audio data output by the device 110 should be relatively low in energy. In addition, either performing adaptive noise cancellation processing and/or residual echo suppression processing may further suppress unwanted noise from the output audio data. Thus, first parameters associated with near-end single-talk conditions 230, second parameters associated with far-end single-talk conditions 240, and/or third parameters associated with double-talk conditions 250 may be applied during no speech conditions 220 without departing from the disclosure. As the device 110 may easily determine that the echo signal and therefore far-end speech is faint during no-speech conditions 220, the device 110 typically applies the first parameters associated with near-end single-talk conditions 230, although the disclosure is not limited thereto.

Further details of the device operation are described below following a discussion of directionality in reference to FIGS. 3-4C.

Figure 3:
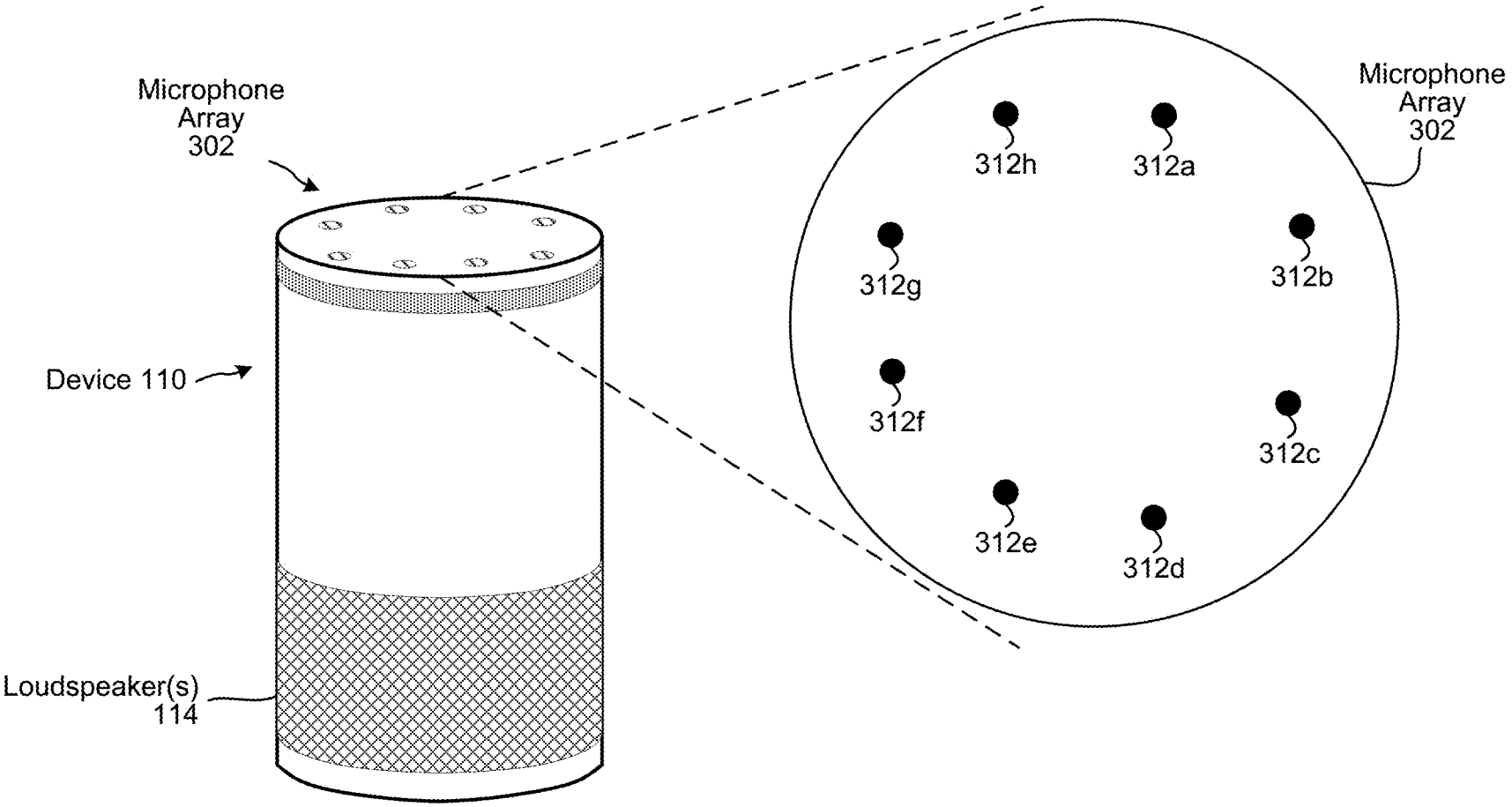
FIG. 3 illustrates a microphone array according to embodiments of the present disclosure.

As illustrated in FIG. 3, a device 110 may include, among other components, a microphone array 302 including a plurality of microphone(s) 312, one or more loudspeaker(s) 114, a beamformer unit (as discussed below), or other components. The microphone array 302 may include a number of different individual microphones 312. In the example configuration of FIG. 3, the microphone array includes eight (8) microphones, 312*a*-312*h*. The individual microphones 312 may capture sound and pass the resulting audio signal created by the sound to a downstream component, such as an analysis filterbank discussed below. Each individual piece of audio data captured by a microphone may be in a time domain. To isolate audio from a particular direction, the device may compare the audio data (or audio signals related to the audio data, such as audio signals in a sub-band domain) to determine a time difference of detection of a particular segment of audio data. If the audio data for a first microphone includes the segment of audio data earlier in time than the audio data for a second microphone, then the device may determine that the source of the audio that resulted in the segment of audio data may be located closer to the first microphone than to the second microphone (which resulted in the audio being detected by the first microphone before being detected by the second microphone).

Figure 4A:
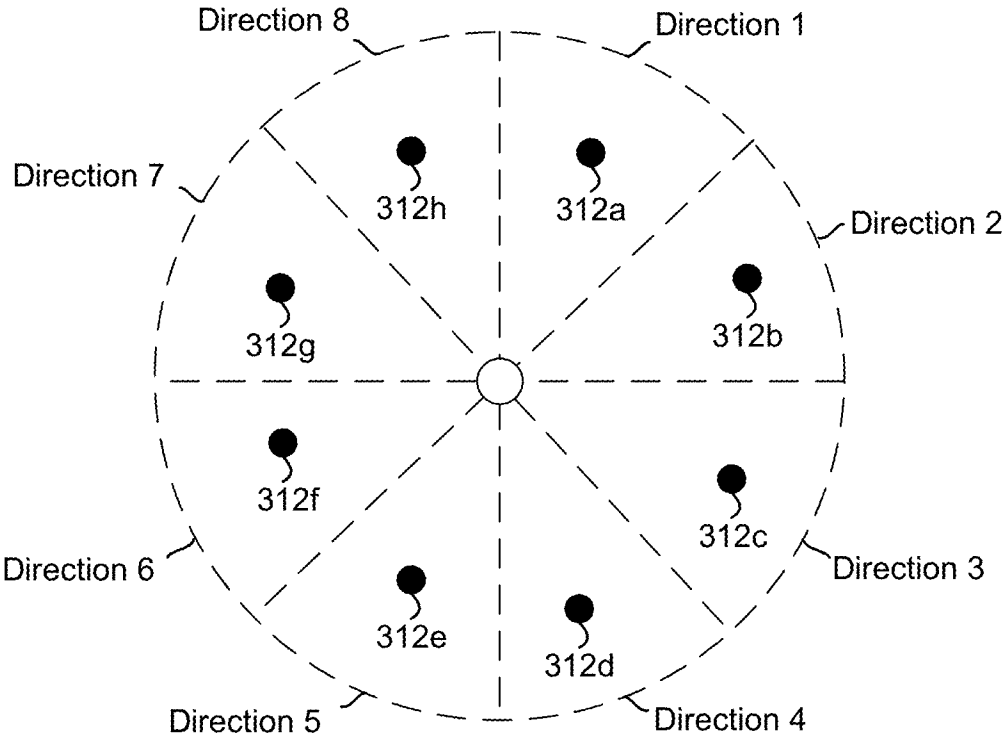
FIG. 4A illustrates associating directions with microphones of a microphone array according to embodiments of the present disclosure.

Using such direction isolation techniques, a device 110 may isolate directionality of audio sources. As shown in FIG. 4A, a particular direction may be associated with a particular microphone 312 of a microphone array, where the azimuth angles for the plane of the microphone array may be divided into bins (e.g., 0-45 degrees, 46-90 degrees, and so forth) where each bin direction is associated with a microphone in the microphone array. For example, direction 1 is associated with microphone 312*a*, direction 2 is associated with microphone 312*b*, and so on. Alternatively, particular directions and/or beams may not necessarily be associated with a specific microphone without departing from the present disclosure. For example, the device 110 may include any number of microphones and/or may isolate any number of directions without departing from the disclosure.

To isolate audio from a particular direction the device may apply a variety of audio filters to the output of the microphones where certain audio is boosted while other audio is dampened, to create isolated audio data corresponding to a particular direction, which may be referred to as a beam. While in some examples the number of beams may correspond to the number of microphones, the disclosure is not limited thereto and the number of beams may vary from the number of microphones without departing from the disclosure. For example, a two-microphone array may be processed to obtain more than two beams, using filters and beamforming techniques to isolate audio from more than two directions. Thus, the number of microphones may be more than, less than, or the same as the number of beams. The beamformer unit of the device may have a fixed beamformer (FBF) unit and/or an adaptive beamformer (ABF) unit processing pipeline for each beam, as explained below.

The device 110 may use various techniques to determine the beam corresponding to the look-direction. For example, if audio is first detected by a particular microphone, the device 110 may determine that the source of the audio is associated with the direction of the microphone in the array. Other techniques may include determining which microphone detected the audio with a largest amplitude (which in turn may result in a highest strength of the audio signal portion corresponding to the audio). Other techniques (either in the time domain or in the sub-band domain) may also be used such as calculating a signal-to-noise ratio (SNR) for each beam, performing voice activity detection (VAD) on each beam, or the like.

Figure 4B:
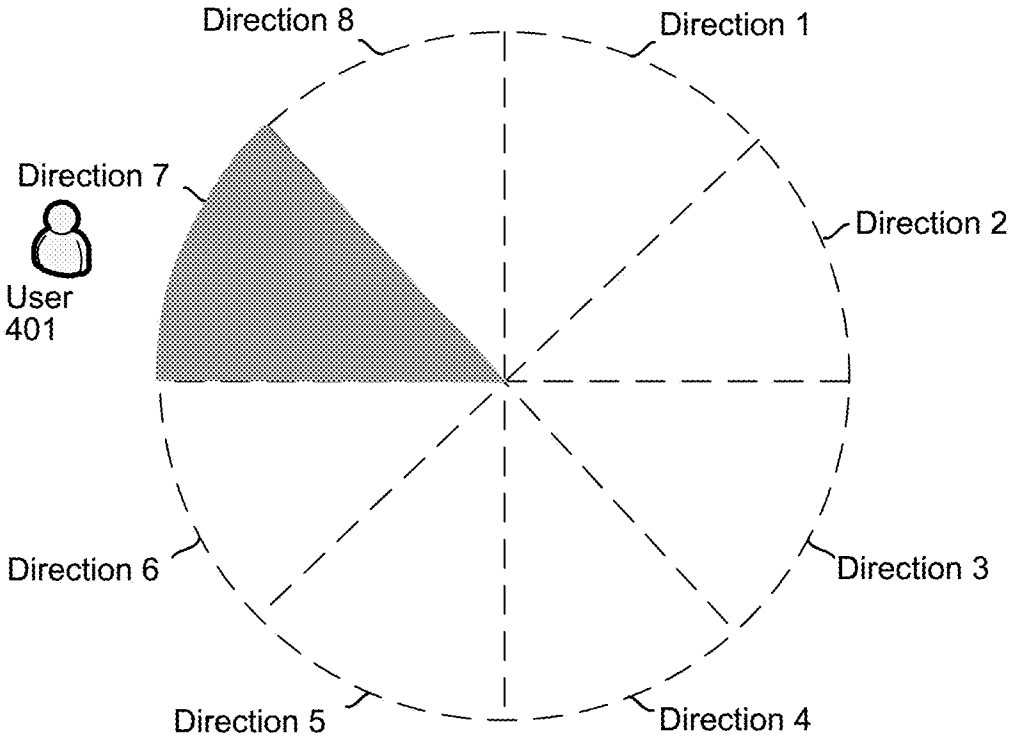
FIGS. 4B and 4C illustrate isolating audio from a direction to focus on a desired audio source according to embodiments of the present disclosure.
Figure 4C:
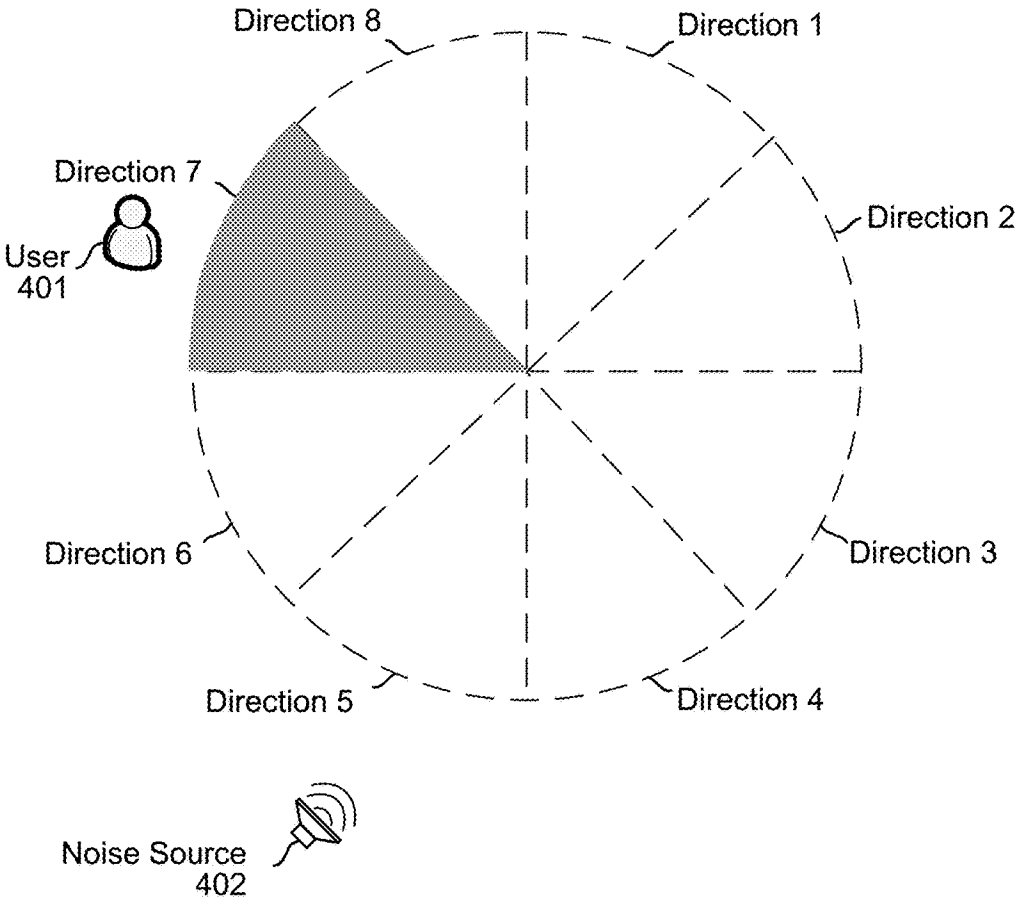

To illustrate an example, if audio data corresponding to a user's speech is first detected and/or is most strongly detected by microphone 312*g*, the device 110 may determine that a user 401 is located at a location in direction 7. Using a FBF unit or other such component, the device 110 may isolate audio data coming from direction 7 using techniques known to the art and/or explained herein. Thus, as shown in FIG. 4B, the device 110 may boost audio data coming from direction 7, thus increasing the amplitude of audio data corresponding to speech from the user 401 relative to other audio data captured from other directions. In this manner, noise from diffuse sources that is coming from all the other directions will be dampened relative to the desired audio (e.g., speech from user 401) coming from direction 7.

One drawback to the FBF unit approach is that it may not function as well in dampening/canceling noise from a noise source that is not diffuse, but rather coherent and focused from a particular direction. For example, as shown in FIG. 4C, a noise source 402 may be coming from direction 5 but may be sufficiently loud that noise canceling/beamforming techniques using an FBF unit alone may not be sufficient to remove all the undesired audio coming from the noise source 402, thus resulting in an ultimate output audio signal determined by the device 110 that includes some representation of the desired audio resulting from user 401 but also some representation of the undesired audio resulting from noise source 402.

Conventional systems isolate the speech in the input audio data by performing acoustic echo cancellation (AEC) to remove the echo signal from the input audio data. For example, conventional acoustic echo cancellation may generate a reference signal based on the playback audio data and may remove the reference signal from the input audio data to generate output audio data representing the speech.

As an alternative to generating the reference signal based on the playback audio data, Adaptive Reference Algorithm (ARA) processing may generate an adaptive reference signal based on the input audio data. The ARA processing is discussed in greater detail above with regard to FIG. 1. For example, the device 110 may perform beamforming using the input audio data to generate a plurality of audio signals (e.g., beamformed audio data) corresponding to particular directions (e.g., a first audio signal corresponding to a first direction, a second audio signal corresponding to a second direction, etc.). After beamforming, the device 110 may optionally perform adaptive interference cancellation using the ARA processing on the beamformed audio data. For example, after generating the plurality of audio signals, the device 110 may determine one or more target signal(s), determine one or more reference signal(s), and generate output audio data by subtracting at least a portion of the reference signal(s) from the target signal(s). For example, the ARA processing may select the first audio signal as a target signal (e.g., the first audio signal includes a representation of speech) and the second audio signal as a reference signal (e.g., the second audio signal includes a representation of the echo and/or other acoustic noise), and may perform AIC by removing (e.g., subtracting) the reference signal from the target signal.

To improve noise cancellation, the AIC component may amplify audio signals from two or more directions other than the look direction (e.g., target signal). These audio signals represent noise signals so the resulting amplified audio signals may be referred to as noise reference signals. The device 110 may then weight the noise reference signals, for example using filters, and combine the weighted noise reference signals into a combined (weighted) noise reference signal. Alternatively the device 110 may not weight the noise reference signals and may simply combine them into the combined noise reference signal without weighting. The device 110 may then subtract the combined noise reference signal from the target signal to obtain a difference (e.g., noise-cancelled audio data). The device 110 may then output that difference, which represents the desired output audio signal with the noise removed. The diffuse noise is removed by the FBF unit when determining the target signal and the directional noise is removed when the combined noise reference signal is subtracted.

The device 110 may dynamically select target signal(s) and/or reference signal(s). Thus, the target signal(s) and/or the reference signal(s) may be continually changing over time based on speech, acoustic noise(s), ambient noise(s), and/or the like in an environment around the device 110. For example, the adaptive beamformer may select the target signal(s) by detecting speech, based on signal strength values (e.g., signal-to-noise ratio (SNR) values, average power values, etc.), and/or using other techniques or inputs, although the disclosure is not limited thereto. As an example of other techniques or inputs, the device 110 may capture video data corresponding to the input audio data, analyze the video data using computer vision processing (e.g., facial recognition, object recognition, or the like) to determine that a user is associated with a first direction, and select the target signal(s) by selecting the first audio signal corresponding to the first direction. Similarly, the device 110 may identify the reference signal(s) based on the signal strength values and/or using other inputs without departing from the disclosure. Thus, the target signal(s) and/or the reference signal(s) selected by the device 110 may vary, resulting in different filter coefficient values over time.

Figure 5A:
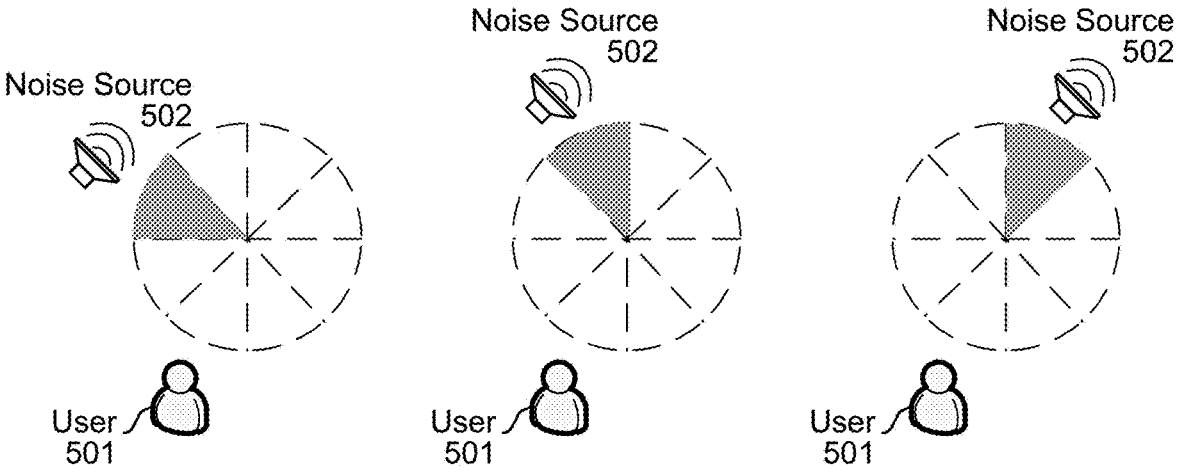
FIGS. 5A-5C illustrate dynamic and fixed reference beam selection according to embodiments of the present disclosure.
Figure 5B:
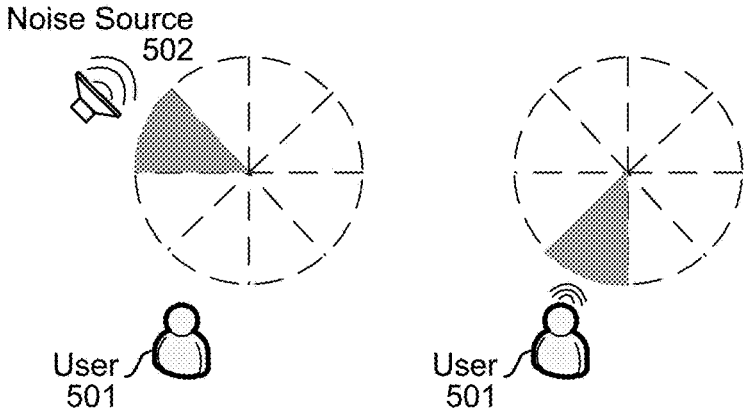
Figure 5C:
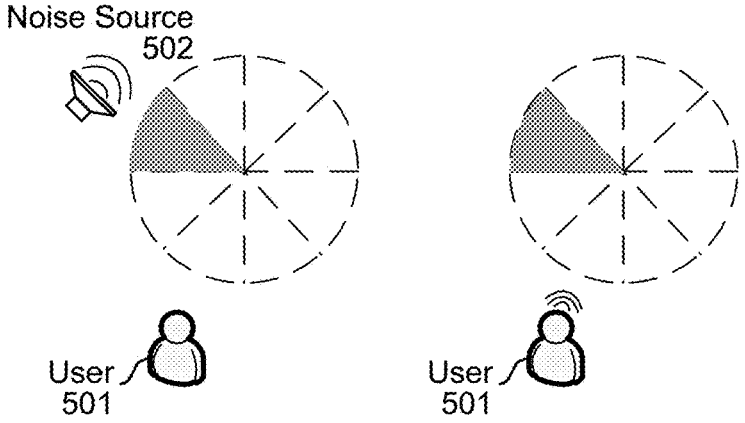

FIGS. 5A-5C illustrate dynamic and fixed reference beam selection according to embodiments of the present disclosure. As discussed above, Adaptive Reference Algorithm (ARA) processing may generate an adaptive reference signal based on the microphone audio data. To illustrate an example, the ARA processing may perform beamforming using the microphone audio data to generate a plurality of audio signals (e.g., beamformed audio data) corresponding to particular directions. For example, the plurality of audio signals may include a first audio signal corresponding to a first direction, a second audio signal corresponding to a second direction, a third audio signal corresponding to a third direction, and so on. The ARA processing may select the first audio signal as a target signal (e.g., the first audio signal includes a representation of speech) and the second audio signal as a reference signal (e.g., the second audio signal includes a representation of the echo and/or other acoustic noise) and may perform acoustic echo cancellation by removing (e.g., subtracting) the reference signal from the target signal. As the microphone audio data is not limited to the echo signal, the ARA processing may remove other acoustic noise represented in the microphone audio data in addition to removing the echo. Therefore, the ARA processing may be referred to as performing adaptive interference cancellation (AIC) (e.g., adaptive acoustic interference cancellation), adaptive noise cancellation (ANC), and/or acoustic echo cancellation (AEC) without departing from the disclosure.

In some examples, the ARA processing may dynamically select the reference beam based on which beamformed audio data has the largest amplitude and/or highest power. Thus, the ARA processing adaptively selects the reference beam depending on the power associated with each beam. This technique works well during far-end single-talk conditions, as the loudspeaker(s) 114 generating output audio based on the far-end reference signal are louder than other sources of noise and therefore the ARA processing selects the beamformed audio data associated with the loudspeaker(s) 114 as a reference signal.

FIG. 5A illustrates an example of dynamic reference beam selection during far-end single-talk conditions. As illustrated in FIG. 5A, the ARA processing selects the beam associated with a noise source 502 (e.g., the loudspeaker(s) 114) as the reference beam. Thus, even as the noise source 502 moves between beams (e.g., beginning at direction 7 and moving to direction 1), the ARA processing is able to dynamically select beamformed audio data associated with the noise source 502 as the reference signal. The ARA processing may select beamformed audio data associated with the user 501 (e.g., direction 5) as a target signal, performing adaptive noise cancellation to remove the reference signal from the target signal and generate output audio data.

While this technique works well during far-end single-talk conditions, performing dynamic reference beam selection during near-end single-talk conditions and/or double-talk conditions does not provide good results. For example, during near-end single-talk conditions and/or when local speech generated by a user 501 is louder than the loudspeaker(s) 114 during double-talk conditions, the ARA processing selects the beam associated with the user 501 instead of the beam associated with the noise source 502 as the reference beam.

FIG. 5B illustrates an example of dynamic reference beam selection during near-end single-talk conditions. As illustrated in FIG. 5B, the ARA processing initially selects a first beam associated with a noise source 502 (e.g., direction 7 associated with the loudspeaker(s) 114) as the reference beam. Thus, the ARA processing selects first beamformed audio data associated with the noise source 502 (e.g., direction 7) as the reference signal and selects second beamformed audio data associated with the user 501 (e.g., direction 5) as a target signal, performing adaptive noise cancellation to remove the reference signal from the target signal and generate output audio data.

However, during near-end single-talk conditions the noise source 502 is silent and the ARA processing only detects audio associated with the local speech generated by the user 501. As the local speech is the loudest audio, the ARA processing selects a second beam associated with the user 501 (e.g., direction 5 associated with the local speech) as the reference beam. Thus, the ARA processing selects the second beamformed audio data associated with the user 501 (e.g., direction 5) as the reference signal. Whether the ARA processing selects the second beamformed audio data associated with the user 501 (e.g., direction 5) as a target signal, or selects beamformed audio data in a different direction as the target signal, the output audio data generated by performing adaptive noise cancellation does not include the local speech.

To improve the ARA processing, the device 110 may freeze reference beam selection during near-end single-talk conditions and/or during double-talk conditions. Thus, the ARA processing may dynamically select the reference beam during far-end single-talk conditions, but as soon as local speech is detected (e.g., near-end single-talk conditions and/or double-talk conditions are detected), the ARA processing may store the most-recently selected reference beam and use this reference beam until far-end single-talk conditions resume. For example, during near-end single-talk conditions and/or when local speech generated by a user 501 is louder than the loudspeaker(s) 114 during double-talk conditions, the ARA processing ignores the beam with the most power and continues to use the reference beam previously selected during far-end single-talk conditions, as this reference beam is most likely to be associated with a noise source.

FIG. 5C illustrates an example of freezing reference beam selection during near-end single-talk conditions. As illustrated in FIG. 5C, the ARA processing initially selects a first beam associated with a noise source 502 (e.g., direction 7 associated with the loudspeaker(s) 114) as the reference beam during far-end single-talk conditions. Thus, the ARA processing selects first beamformed audio data associated with the noise source 502 (e.g., direction 7) as the reference signal and selects second beamformed audio data associated with the user 501 (e.g., direction 5) as a target signal, performing adaptive noise cancellation to remove the reference signal from the target signal and generate output audio data.

When the device 110 detects near-end single-talk conditions, the ARA processing freezes dynamic reference beam selection and stores the first beam associated with the noise source 502 (e.g., direction 7 associated with the loudspeaker(s) 114) as the reference beam until far-end single-talk conditions resume. Thus, during near-end single-talk conditions and/or when local speech generated by the user 501 is louder than the noise source 502 during double-talk conditions, the ARA processing continues to select the first beamformed audio data associated with the noise source 502 (e.g., direction 7) as the reference signal and selects the second beamformed audio data associated with the user 501 (e.g., direction 5) as the target signal, performing adaptive noise cancellation to remove the reference signal from the target signal and generate the output audio data.

As described above with regard to FIG. 2, the device 110 may set a number of parameters differently between far-end single-talk conditions and either near-end single-talk conditions or double-talk conditions. As illustrated in FIG. 5C, the device 110 may perform dynamic reference beam selection during far-end single-talk conditions but may freeze reference beam selection during near-end single-talk conditions and double-talk conditions. Similarly, the device 110 may adapt filter coefficients associated with an adaptive filter during far-end single-talk conditions but may freeze filter coefficient adaptation during near-end single-talk conditions and double-talk conditions. For example, in order to remove an echo associated with the far-end reference signal, the device adapts the filter coefficients during far-end single-talk conditions to minimize an "error signal" (e.g., output of the AIC component 120). However, the error signal should not be minimized during near-end single-talk conditions and double-talk conditions as the output of the AIC component 120 includes the local speech. Therefore, because continuing to adapt the filter coefficients during near-end single-talk conditions and double-talk conditions would result in the AIC component 120 removing portions of the local speech from the output audio data, the device 110 freezes filter coefficient adaptation. Freezing filter coefficient adaptation refers to the device 110 disabling filter coefficient adaptation, such as by storing current filter coefficient values and using the stored filter coefficient values until filter coefficient adaptation is enabled again. Once filter coefficient adaptation is enabled (e.g., unfrozen), the device 110 dynamically adapts the filter coefficient values.

Finally, the device 110 may enable residual echo suppression (RES) processing and/or apply aggressive RES processing during far-end single-talk conditions (e.g., to suppress unwanted noise and echo), but disable RES processing and/or apply slight RES processing during near-end single-talk conditions and double-talk conditions (e.g., to improve a quality of the local speech).

In some examples, the device 110 may apply different settings, parameters, and/or the like based on whether near-end single talk conditions are present or double-talk conditions are present. For example, the device 110 may apply slightly more audio processing, such as stronger AIC processing, RES processing, and/or the like, during double-talk conditions than during near-end single-talk conditions, in order to remove a portion of the echo signal. Additionally or alternatively, the device 110 may bypass the AIC component 120 and/or the RES component 122 entirely during near-end single talk conditions and not apply AIC processing and/or RES processing without departing from the disclosure.

Figure 6A:
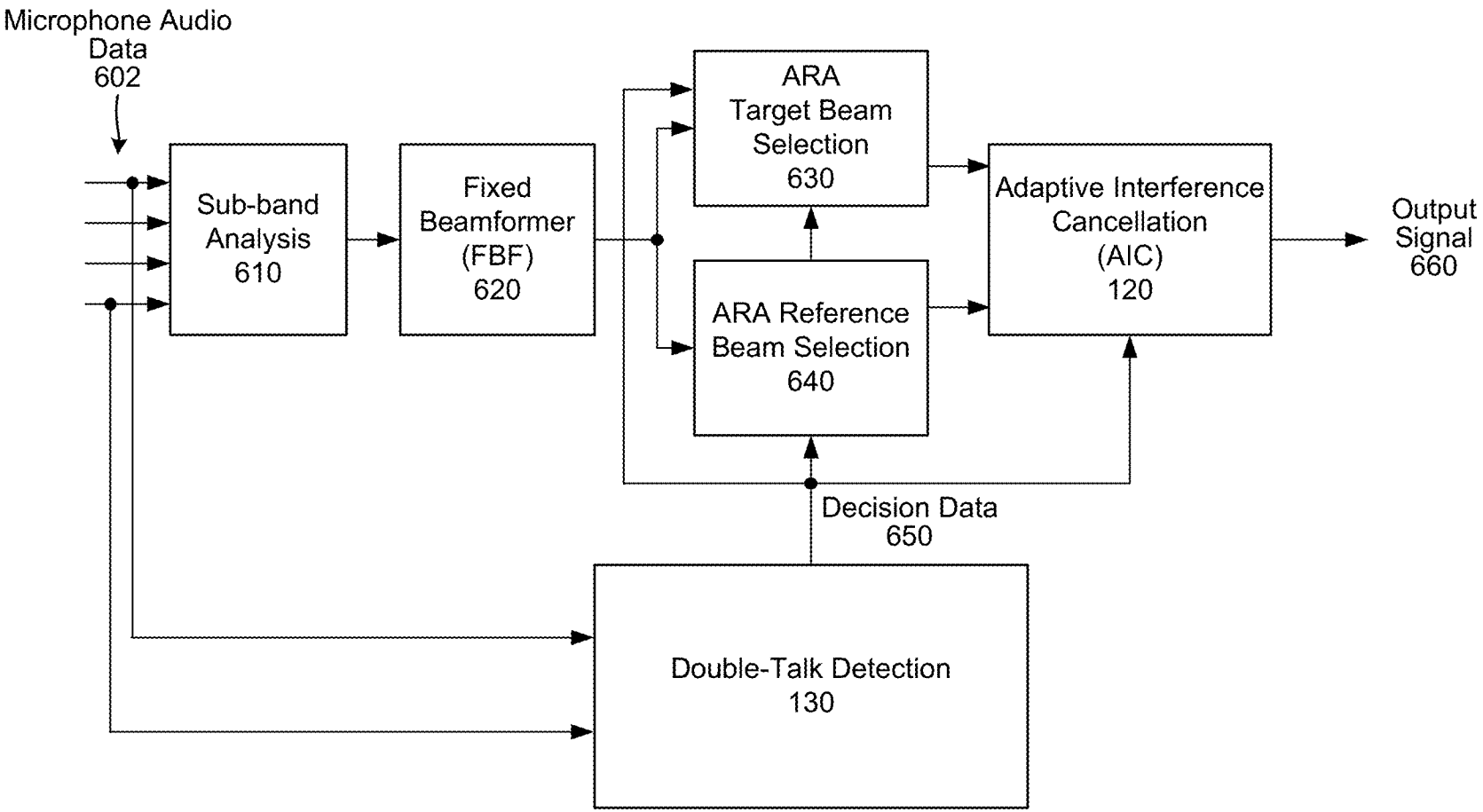
FIGS. 6A-6B illustrate example components for performing double-talk detection according to examples of the present disclosure.
Figure 6B:
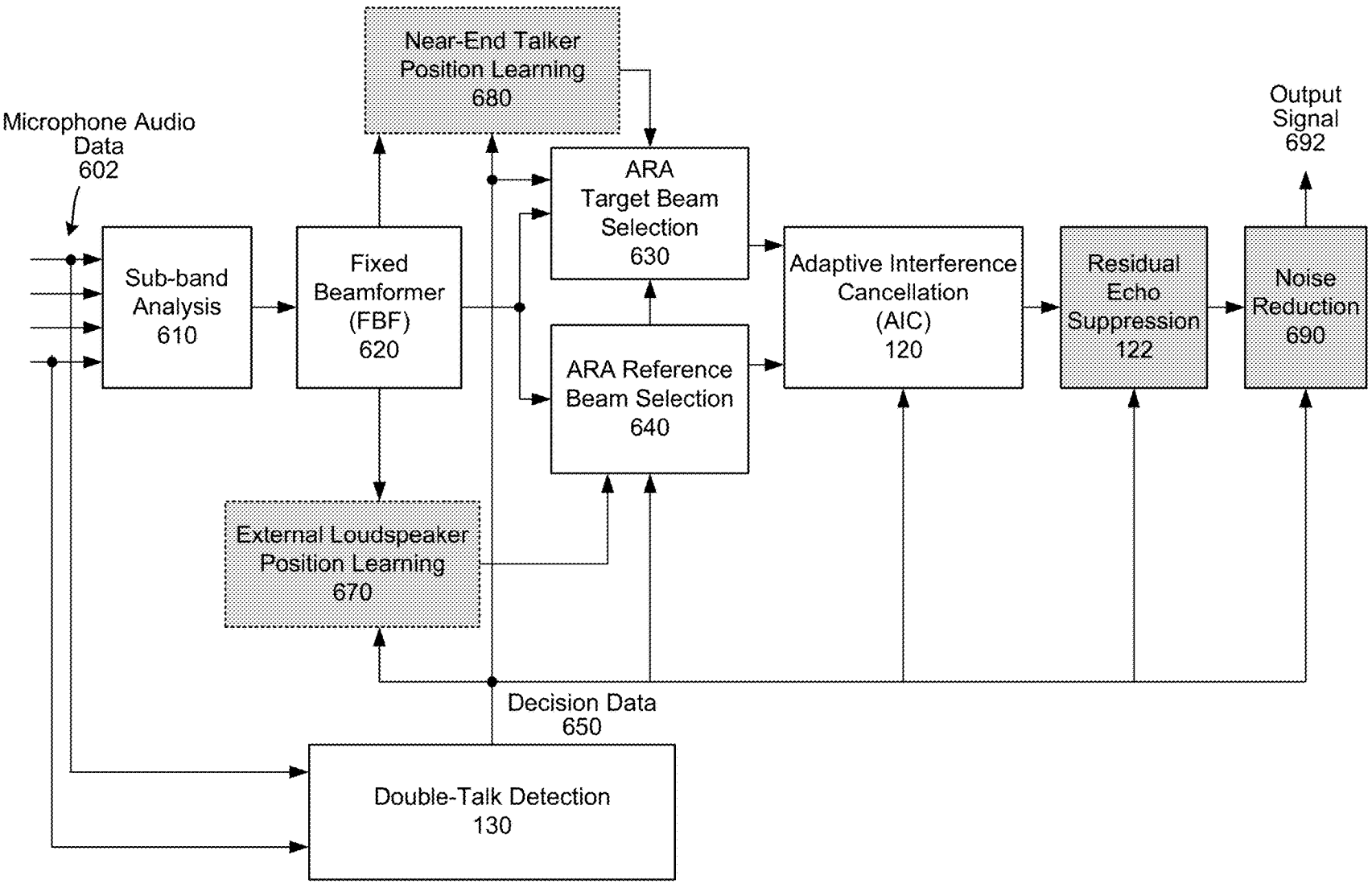

FIGS. 6A-6B illustrate example components for performing double-talk detection according to examples of the present disclosure. As illustrated in FIG. 6A, one or more of the microphone(s) 112 may generate microphone audio data 602 (e.g., near-end reference signal) in a time domain, which may be input to sub-band analysis 610 prior to performing audio processing in a frequency domain. For example, the sub-band analysis 610 may include a uniform discrete Fourier transform (DFT) filterbank to convert the microphone audio data 602 from the time domain into the sub-band domain (e.g., converting to the frequency domain and then separating different frequency ranges into a plurality of individual sub-bands). Therefore, the audio signal X may incorporate audio signals corresponding to multiple different microphones as well as different sub-bands (i.e., frequency ranges) as well as different frame indices (i.e., time ranges). Thus, the audio signal from the mth microphone may be represented as $X_m(k, n)$, where k denotes the sub-band index and n denotes the frame index. The combination of all audio signals for all microphones for a particular sub-band index frame index may be represented as X(k,n).

After being converted to the sub-band domain, the microphone audio data may be input to a fixed beamformer (FBF) 620, which may perform beamforming on the near-end reference signal. For example, the FBF 620 may apply a variety of audio filters to the output of the sub-band analysis 610, where certain audio data is boosted while other audio data is dampened, to create beamformed audio data corresponding to a particular direction, which may be referred to as a beam. The FBF 620 may generate beamformed audio data using any number of beams without departing from the disclosure.

The beamformed audio data output by the FBF 620 may be sent to Adaptive Reference Algorithm (ARA) target beam selection component 630 and/or ARA reference beam selection component 640. As discussed above with regard to FIGS. 5A-5C, ARA processing may dynamically select one or more of the beams output by the FBF 620 as target signal(s) as well as one or more of the beams output by the FBF 620 as reference signal(s) with which to perform AIC processing. Thus, the ARA target beam selection component 630 may select one or more beams as target beam(s), identify a portion of the beamformed audio data corresponding to the target beam(s) as target signal(s) (e.g., first beamformed audio), and send the target signal(s) to an adaptive interference cancellation (AIC) component 120. Similarly, the ARA reference beam selection component 6N40 may select one or more beams as reference beam(s), identify a portion of the beamformed audio data corresponding to the reference beam(s) as reference signal(s) (e.g., second beamformed audio), and send the reference signal(s) to the AIC component 120.

The AIC component 120 may generate an output signal 660 by subtracting the reference signal(s) from the target signal(s). For example, the AIC component 120 may generate the output signal 660 by subtracting the second beamformed audio data associated with the reference beam(s) from the first beamformed audio data associated with the target beam(s).

The double-talk detection component 130 may receive the microphone audio data 602 corresponding to two microphones 112 and may generate decision data 650. For example, the double-talk detection component 130 may include an adaptive filter that performs AIC processing using a first microphone signal as a target signal and a second microphone signal as a reference signal. To avoid confusion with the adaptive filter associated with the AIC component 120, the adaptive filter associated with the double-talk detection component 130 may be referred to as a least mean squares (LMS) adaptive filter, and corresponding filter coefficient values may be referred to as LMS filter coefficient data. Based on the LMS filter coefficient data of the adaptive filter, the double-talk detection component 130 may determine if near-end single-talk conditions, far-end single-talk conditions, or double-talk conditions are present. For example, the double-talk detection component 130 may distinguish between single-talk conditions and double-talk conditions based on a number of peaks represented in the LMS filter coefficient data. Thus, a single peak corresponds to single-talk conditions, whereas two or more peaks may correspond to double-talk conditions.

In some examples, the double-talk detection component 130 may only update the LMS filter coefficients for the LMS adaptive filter when a meaningful signal is detected. For example, the LMS filter coefficients will not be updated during no speech conditions 220 (e.g., speech silence). The device 110 may use various techniques to determine whether audio data includes speech. Some embodiments may apply voice activity detection (VAD) techniques. Such techniques may determine whether speech is present in an audio input based on various quantitative aspects of the audio input, such as the spectral slope between one or more frames of the audio input; the energy levels of the audio input in one or more spectral bands; the signal-to-noise ratios of the audio input in one or more spectral bands; or other quantitative aspects. In other embodiments, the device 110 may implement a limited classifier configured to distinguish speech from background noise. The classifier may be implemented by techniques such as linear classifiers, support vector machines, and decision trees. In still other embodiments, Hidden Markov Model (HMM) or Gaussian Mixture Model (GMM) techniques may be applied to compare the audio input to one or more acoustic models in speech storage, which acoustic models may include models corresponding to speech, noise (such as environmental noise or background noise), or silence. Still other techniques may be used to determine whether speech is present in the audio input.

In some examples, a VAD detector may detect whether voice activity (i.e., speech) is present in the post-FFT waveforms associated with the microphone audio data (e.g., frequency domain framed audio data output by the sub-band analysis component 610). The VAD detector (or other components) may also be configured in a different order, for example the VAD detector may operate on the microphone audio data 602 in the time domain rather than in the frequency domain without departing from the disclosure. Various different configurations of components are possible.

If there is no speech in the microphone audio data 602, the device 110 discards the microphone audio data 602 (i.e., removes the audio data from the processing stream) and/or doesn't update the LMS filter coefficients. If, instead, the VAD detector detects speech in the microphone audio data 602, the device 110 performs double-talk detection on the microphone audio data 602 and/or updates the LMS filter coefficients of the LMS adaptive filter.

In some examples, the double-talk detection component 130 may receive additional input not illustrated in FIG. 6A. For example, the device 110 may separately determine whether far-end speech is present in the microphone audio data 602 using various techniques known to one of skill in the art. When the device 110 determines that far-end speech is not present in the microphone audio data 602, the double-talk detection component 130 determines that near-end single-talk conditions are present, regardless of a number of peaks represented in the LMS filter coefficient data (e.g., a single peak indicates a single user local to the device 110, whereas multiple peaks indicates multiple users local to the device 110). However, when the device 110 determines that far-end speech is present in the microphone audio data 602, the double-talk detection component 130 may distinguish between far-end single-talk conditions (e.g., a single peak represented in the LMS filter coefficient data) and double-talk conditions (e.g., two or more peaks represented in the LMS filter coefficient data).

In some examples, the double-talk detection component 130 may generate decision data 650 that indicates current system conditions (e.g., near-end single-talk conditions, far-end single-talk conditions, or double-talk conditions). Thus, the double-talk detection component 130 may indicate the current system conditions to the ARA target beam selection component 630, the ARA reference beam selection component 640, the AIC component 120, and/or additional components of the device 110. However, the disclosure is not limited thereto and the double-talk detection component 130 may generate decision data 650 indicating additional information without departing from the disclosure.

In some examples, the decision data 650 may include location data indicating a location (e.g., direction relative to the device 110) associated with each of the peaks represented in the LMS filter coefficient data. For example, individual filter coefficients of the LMS adaptive filter may correspond to a time of arrival of the audible sound, enabling the device 110 to determine the direction of an audio source relative to the device 110. Thus, the double-talk detection component 130 may generate decision data 650 that indicates the current system conditions, a number of peak(s) represented in the LMS filter coefficient data, and/or the location(s) of the peak(s), and may send the decision data 650 to the ARA target beam selection component 630, the ARA reference beam selection component 640, the AIC component 120, and/or additional components of the device 110.

To illustrate a first example, when the device 110 determines that far-end speech is not present, the double-talk detection component 130 may generate decision data 650 indicating that near-end single-talk conditions are present along with direction(s) associated with local speech generated by one or more local users. For example, if the double-talk detection component 130 determines that only a single peak is represented during a first duration of time, the double-talk detection component 130 may determine a first direction associated with a first user during the first duration of time. However, if the double-talk detection component 130 determines that two peaks are represented during a second duration of time, the double-talk detection component 130 may determine the first direction associated with the first user and a second direction associated with a second user. In addition, the double-talk detection component 130 may track the users over time and/or associate a particular direction with a particular user based on previous local speech during near-end single-talk conditions.

To illustrate a second example, when the device 110 determines that far-end speech is present, the double-talk detection component 130 may generate decision data 650 indicating system conditions (e.g., far-end single talk conditions or double-talk conditions), along with a number of peak(s) represented in the LMS filter coefficient data and/or location(s) associated with the peak(s). For example, if the double-talk detection component 130 determines that only a single peak is represented in the LMS filter coefficient data during a third duration of time, the double-talk detection component 130 may generate decision data 650 indicating that far-end single-talk conditions are present and identifying a third direction associated with the loudspeaker 114 outputting the far-end speech during the third duration of time. However, if the double-talk detection component 130 determines that two or more peaks are represented in the LMS filter coefficient data during a fourth duration of time, the double-talk detection component 130 may generate decision data 650 indicating that double-talk conditions are present, identifying the third direction associated with the loudspeaker 114, and identifying a fourth direction associated with a local user. In addition, the double-talk detection component 130 may track the loudspeaker 114 over time and/or associate a particular direction with the loudspeaker 114 based on previous far-end single-talk conditions.

In some examples, the double-talk detection component 130 may output unique information to different components of the device 110. For example, during near-end single-talk conditions the double-talk detection component 130 may output a ST/DT decision to the ARA reference beam selection component 640 but may output the ST/DT decision, a number of peaks and location(s) of the peaks to the ARA target beam selection component 630. Similarly, during far-end single-talk conditions the double-talk detection component 130 may output the ST/DT decision to the ARA target beam selection component 630 but may output the ST/DT decision, the number of peaks and the location(s) of the peaks to the ARA reference beam selection component 640. During double-talk conditions, the double-talk detection component 130 may output the ST/DT decision and a first location associated with the talker to the ARA target beam selection component 630 and may output the ST/DT decision and a second location associated with the loudspeaker to the ARA reference beam selection component 640.

As the double-talk detection component 130 may track first direction(s) associated with local users during near-end single-talk conditions and second direction(s) associated with the loudspeaker(s) 114 during far-end single-talk conditions, the double-talk detection component 130 may determine whether double-talk conditions are present in part based on the locations of peaks represented in the LMS filter coefficient data. For example, the double-talk detection component 130 may determine that two peaks are represented in the LMS filter coefficient data but that both locations were previously associated with local users during near-end single-talk conditions. Therefore, the double-talk detection component 130 may determine that near-end single-talk conditions are present. Additionally or alternatively, the double-talk detection component 130 may determine that two peaks are represented in the LMS filter coefficient data but that one location was previously associated with the loudspeaker 114 during far-end single-talk conditions. Therefore, the double-talk detection component 130 may determine that double-talk conditions are present In some examples, the ARA target beam selection component 630 may select the target beam(s) based on location data (e.g., location(s) associated with near-end speech, such as a local user) included in the detection data 650 received from the double-talk detection component 130. However, the disclosure is not limited thereto and the ARA target beam selection component 630 may select the target beam(s) using techniques known to one of skill in the art without departing from the disclosure. For example, the ARA target beam selection component 630 may detect local speech represented in the beamformed audio data, may track a direction associated with a user (e.g., identify direction(s) associated with near-end single-talk conditions), may determine the direction associated with the user using facial recognition, and/or the like without departing from the disclosure.

In some examples, the ARA reference beam selection component 640 may select the reference beam(s) based on location data (e.g., location(s) associated with far-end speech, such as the loudspeaker(s) 114 outputting the far-end speech) included in the detection data 650 received from the double-talk detection component 130. However, the disclosure is not limited thereto and the ARA reference beam selection component 640 may select the reference beam(s) using techniques known to one of skill in the art without departing from the disclosure. For example, the ARA reference beam selection component 640 may detect remote speech represented in the beamformed audio data, may track a direction associated with a loudspeaker 114 (e.g., identify direction(s) associated with far-end single-talk conditions), may determine the direction associated with the loudspeaker(s) 114 using computer vision processing, and/or the like without departing from the disclosure.

In order to avoid selecting an output of the loudspeaker(s) 114 as a target signal, the ARA target beam selection component 630 may dynamically select the target beam(s) only during near-end single-talk conditions. Thus, the ARA target beam selection component 630 may freeze target beam selection and store the currently selected target beam(s) when the device 110 determines that far-end single-talk conditions and/or double-talk conditions are present (e.g., the device 110 detects far-end speech). For example, if the ARA target beam selection component 630 selects a first direction (e.g., Direction 1) as the target beam during near-end single-talk conditions, the ARA target beam selection component 630 may store the first direction as the target beam during far-end single-talk conditions and/or double-talk conditions, such that the target signal(s) correspond to beamformed audio data associated with the first direction. Thus, the target beam(s) remain fixed (e.g., associated with the first direction) whether the target signal(s) represent local speech (e.g., during double-talk conditions) or not (e.g., during far-end single-talk conditions).

Similarly, in order to avoid selecting the local speech as a reference signal, the ARA reference beam selection component 640 may select the reference beam(s) only during far-end single-talk conditions. Thus, the ARA reference beam selection component 640 may freeze reference beam selection and store the currently selected reference beam(s) when the device 110 determines that near-end single-talk conditions and/or double-talk conditions are present (e.g., the device 110 detects near-end speech). For example, if the ARA reference beam selection component 640 selects a fifth direction (e.g., Direction 5) as the reference beam during far-end single-talk conditions, the ARA reference beam selection component 640 may store the fifth direction as the reference beam during near-end single-talk conditions and/or double-talk conditions, such that the reference signal(s) correspond to beamformed audio data associated with the fifth direction. Thus, the reference beam(s) remain fixed (e.g., associated with the fifth direction) whether the reference signal(s) represent remote speech (e.g., during double-talk conditions) or not (e.g., during near-end single-talk conditions).

To illustrate an example, in response to the device 110 determining that near-end single-talk conditions are present, the ARA reference beam selection component 640 may store previously selected reference beam(s) and the ARA target beam selection component 630 may dynamically select target beam(s) using the beamformed audio data output by the FBF 620. While the near-end single-talk conditions are present, the AIC component 120 may generate an output signal 660 by subtracting reference signal(s) corresponding to the fixed reference beam(s) from target signal(s) corresponding to the dynamic target beam(s). If the device 110 determines that double-talk conditions are present, the ARA target beam selection component 630 may store the previously selected target beam(s) and the AIC component 120 may generate the output signal 660 by subtracting reference signal(s) corresponding to the fixed reference beam(s) from target signal(s) corresponding to the fixed target beam(s). Finally, if the device 110 determining that far-end single-talk conditions are present, the ARA reference beam selection component 640 may dynamically select reference beam(s) using the beamformed audio data output by the FBF 620. Thus, the far-end single-talk conditions are present, the AIC component 120 may generate the output signal 660 by subtracting reference signal(s) corresponding to the dynamic reference beam(s) from target signal(s) corresponding to the fixed target beam(s).

FIG. 6B illustrates an example of a detailed component diagram that includes additional components not illustrated in FIG. 6A. For example, in some examples the device 110 may include an external loudspeaker position learning component 670. As illustrated in FIG. 6B, the external loudspeaker position learning component 670 may receive inputs from the FBF 620 and/or the double-talk detector component 130 and may generate an output to the ARA reference beam selection component 640. For example, the external loudspeaker position learning component 670 may track the loudspeaker 114 over time and send this information to the ARA reference beam selection component 640. However, the disclosure is not limited thereto and the external loudspeaker position learning component 670 may be included as part of the ARA reference beam selection component 640 without departing from the disclosure.

Similarly, the device 110 may include a near-end talker position learning component 680 (e.g., local user tracking component) similar to the external loudspeaker position learning component 670 without departing from the disclosure. As illustrated in FIG. 6B, the near-end talker position learning component 680 may receive inputs from the FBF 620 and/or the double-talk detector component 130 and may generate an output to the ARA target beam selection component 630. For example, the near-end talker position learning component 680 may track the local user over time and send this information to the ARA target beam selection component 630. However, the disclosure is not limited thereto and the near-end talker position learning component 680 may be included as part of the ARA target beam selection component 630 without departing from the disclosure.

The output of the AIC component 120 may be input to Residual Echo Suppression (RES) component 122, which may perform residual echo suppression processing to suppress echo signals (or undesired audio) remaining after echo cancellation. In some examples, the RES component 122 may only perform RES processing during far-end single-talk conditions, to ensure that the local speech is not suppressed or distorted during near-end single-talk conditions and/or double-talk conditions. However, the disclosure is not limited thereto and in other examples the RES component 122 may perform aggressive RES processing during far-end single-talk conditions and minor RES processing during double-talk conditions. Thus, the system conditions may dictate an amount of RES processing applied, without explicitly disabling the RES component 122. Additionally or alternatively, the RES component 122 may apply RES processing to high frequency bands using a first gain value (and/or first attenuation value), regardless of the system conditions, and may switch between applying the first gain value (e.g., greater suppression) to low frequency bands during far-end single-talk conditions and applying a second gain value (and/or second attenuation value) to the low frequency bands during near-end single-talk conditions and/or double-talk conditions. Thus, the system conditions control an amount of gain applied to the low frequency bands, which are commonly associated with speech.

After the RES component 122, the device 110 may include a noise reduction component 690 configured to apply noise reduction to generate an output signal 692. In some examples, the device 110 may include adaptive gain control (AGC) (not illustrated) and/or dynamic range compression (DRC) (not illustrated) (which may also be referred to as dynamic range control) to generate output audio data in a sub-band domain. The device 110 may apply the noise reduction, the AGC, and/or the DRC using any techniques known to one of skill in the art. In addition, the device 110 may include a sub-band synthesis (not illustrated) to convert the output audio data from the sub-band domain to the time domain. For example, the output audio data in the sub-band domain may include a plurality of separate sub-bands (e.g., individual frequency bands) and the sub-band synthesis may correspond to a filter bank that combines the plurality of sub-bands to generate the output signal in the time domain.

As illustrated in FIG. 6B, the double-talk detection component 130 may generate decision data 650 that indicates the current system conditions, a number of peak(s) represented in the LMS filter coefficient data, and/or the location(s) of the peak(s), and may send the decision data 650 to the ARA target beam selection component 630, the ARA reference beam selection component 640, the AIC component 120, the RES component 122, the external loudspeaker position learning component 670, the near-end talker position learning component 680, the noise reduction component 690, and/or additional components of the device 110 without departing from the disclosure.

While FIGS. 6A-6B and other examples illustrate the device 110 performing beamforming to generate a plurality of audio signals, and therefore the device 110 selects target signals and/or reference signals from the beamformed audio data, the disclosure is not limited thereto. Instead, the device 110 may select target signals and/or reference signals from the microphone audio data without performing beamforming. For example, a first microphone may be positioned in proximity to the loudspeaker(s) 114 or other sources of acoustic noise while a second microphone may be positioned in proximity to the user 10. Thus, the device 110 may select first microphone audio data associated with the first microphone as the reference signal and may select second microphone audio data associated with the second microphone as the target signal without departing from the disclosure. Additionally or alternatively, the device 110 may select the target signals and/or the reference signals from a combination of the beamformed audio data and the microphone audio data without departing from the disclosure.

Figure 7A:
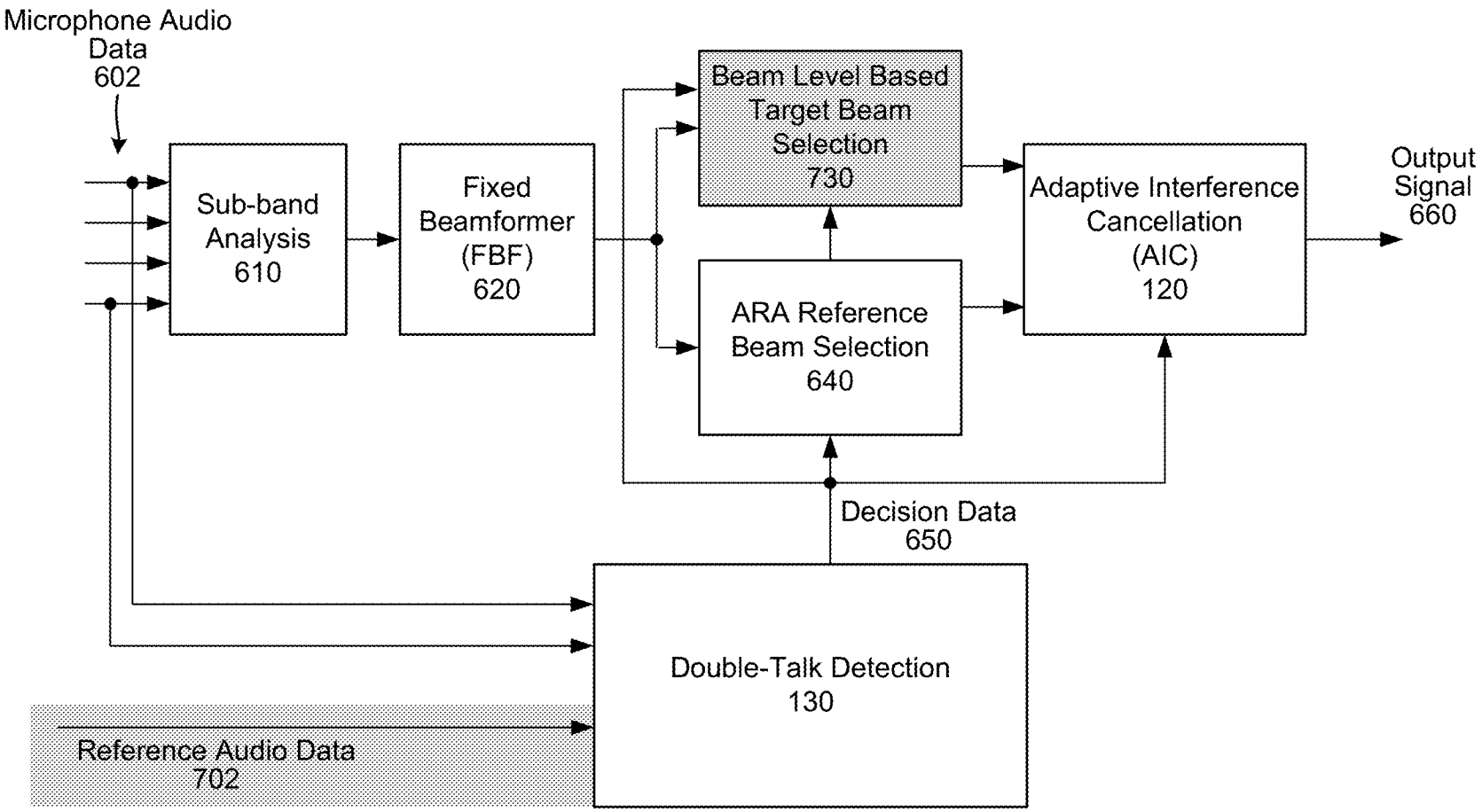
FIGS. 7A-7B illustrate example components for performing beam level based target beam selection according to examples of the present disclosure.
Figure 7B:
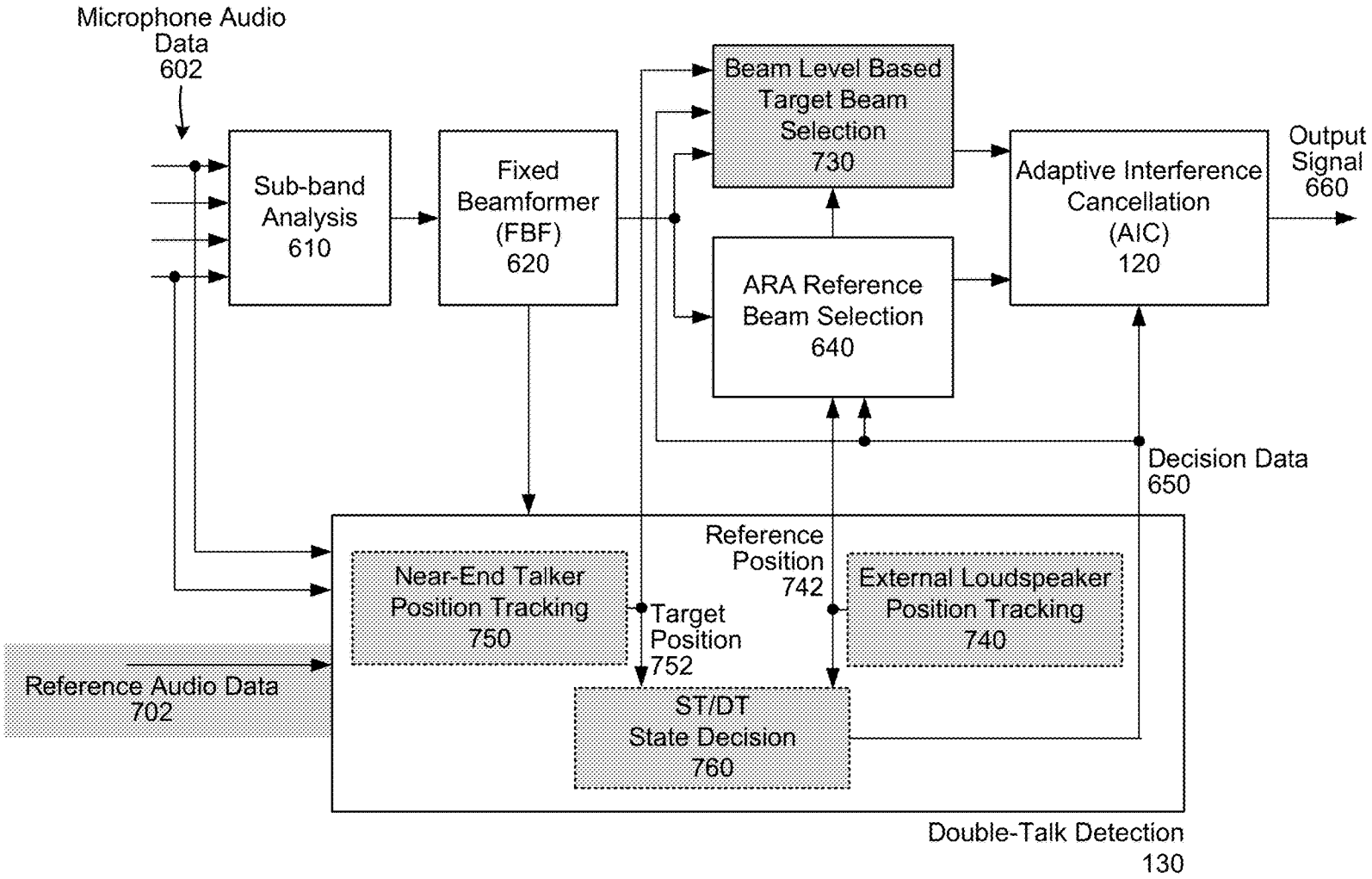

FIGS. 7A-7B illustrate example components for performing beam level based target beam selection according to examples of the present disclosure. As several components illustrated in FIGS. 7A-7B were previously described with regard to FIGS. 6A-6B, a corresponding description is omitted. While the double-talk detection component 130 may operate as described above, FIG. 7A illustrates that in some examples the device 110 may input reference audio data 702 into the double-talk detection component 130. Thus, the double-talk detection component 130 may determine the current system conditions at least in part based on the reference audio data 702. For example, the double-talk detector component 130 may include an additional detector that compares the microphone audio data 602 to the reference audio data 702, as described in greater detail below with regard to FIG. 8A.

As illustrated in FIG. 7A, the device 110 may include a beam level based target beam selection component 730 instead of the ARA target beam selection component 630. Thus, the double-talk detection component 130 may send the decision data 650 to the beam level based target beam selection 730. As described above, the beam level based target beam selection component 730 may select the target signal based on different criteria depending on current system conditions and may output the target signal to the AIC component 120. For example, the beam level based target beam selection component 730 may select a target signal based on a highest signal quality metric value during near-end single-talk conditions and may select the target signal based on a lowest signal quality metric value during far-end single-talk conditions.

To illustrate an example, the device 110 may determine whether current system conditions correspond to near-end single-talk, far-end single-talk, or double-talk conditions using the double-talk detection component 130, as described in greater detail above. If the current system conditions correspond to near-end single-talk conditions, the device 110 may set near-end single-talk parameters (e.g., first parameters), as discussed above with regard to FIG. 2, and the ARA reference beam selection component 640 may maintain a previous reference signal. For example, the device 110 may have previously selected one or more audio signals as the reference signal during far-end single-talk conditions, and the device 110 may continue using the one or more audio signals as the reference signal. As used herein, "a reference signal" is used to refer to any number of audio signals and/or portions of audio data and is not limited to a single audio signal associated with a single direction. For example, the reference signal may correspond to a combination of the first audio signal and the second audio signal without departing from the disclosure.

Based on the reference signal, the device 110 may select a target signal based on a highest signal quality metric value (e.g., signal-to-interference ratio (SIR) value) from the remaining audio signals of the plurality of audio signals that are not associated with the reference signal. For example, if the reference signal corresponds to a combination of the first audio signal and the second audio signal, the beam level based target beam selection component 730 may determine an SIR value for each of the remaining audio signals in the plurality of audio signals. The SIR value may be calculated by dividing a first value (e.g., loudness value, root means square (RMS) value, and/or the like) associated with an individual non-reference audio signal by a second value associated with the reference signal (e.g., combination of the first audio signal and the second audio signal).

To illustrate an example, the beam level based target beam selection component 730 may determine a first SIR value associated with a third audio signal by dividing a first value associated with the third audio signal by a second value associated with the first audio signal and the second audio signal. Similarly, the device 110 may determine a second SIR value associated with a fourth audio signal by dividing a third value associated with the fourth audio signal by the second value associated with the first audio signal and the second audio signal. The device 110 may then compare the SIR values to determine a highest SIR value and may select a corresponding audio signal as the target signal. Thus, if the first SIR value is greater than the second SIR value and any other SIR values associated with the plurality of audio signals, the device 110 may select the third audio signal as the target signal. As used herein, "a target signal" is used to refer to any number of audio signals and/or portions of audio data and is not limited to a single audio signal associated with a single direction. For example, the target signal may correspond to a combination of the third audio signal and the fourth audio signal without departing from the disclosure.

If the current system conditions correspond to far-end single-talk conditions, the device 110 may set far-end single-talk parameters (e.g., second parameters), as discussed above with regard to FIG. 2, and the ARA reference beam selection component 640 may select a reference signal based on a highest signal quality metric (e.g., signal to noise ratio (SNR) value, average power value, and/or the like). For example, the device 110 may determine a signal quality metric value for each of the plurality of audio signals and may select one or more of the plurality of audio signals associated with one or more of the highest signal quality metric values as the reference signal.

Based on the reference signal, the device 110 may select a target signal based on a lowest signal quality metric value (e.g., signal-to-interference ratio (SIR) value) from the remaining audio signals of the plurality of audio signals that are not associated with the reference signal. For example, if the reference signal corresponds to a combination of the first audio signal and the second audio signal, the beam level based target beam selection component 730 may determine an SIR value for each of the remaining audio signals in the plurality of audio signals.

If the current system conditions correspond to double-talk conditions, the device 110 may set double-talk parameters (e.g., third parameters), as discussed above with regard to FIG. 2, the beam level based target beam selection component 730 may maintain a previous target signal and the ARA reference beam selection component 640 may maintain a previous reference signal. For example, the beam level based target beam selection component 730 may determine the target signal selected most recently during near-end single-talk conditions and the ARA reference beam selection component 640 may determine the reference signal selected most recently during far-end single-talk conditions. However, the disclosure is not limited thereto and the device 110 may select the target signal based on a highest signal quality metric without departing from the disclosure.

Whether the current system conditions correspond to near-end single-talk conditions, far-end single-talk conditions, or double-talk conditions, the device 110 may generate the output signal 660 by subtracting the reference signal from the target signal. For example, the AIC component 120 may subtract one or more first audio signals associated with the reference signal from one or more second audio signals associated with the target signal.

FIG. 7B illustrates many of the same components illustrated in FIG. 7A, with the double-talk detection component 130 illustrated as including additional components such as an external loudspeaker position tracking component 740, a near-end talker position tracker component 750, and/or a single-talk/double-talk (ST/DT) state decision component 760.

The external loudspeaker position tracking component 740 operates similar to the external loudspeaker position learning component 670 described above with regard to FIG. 6B. For example, the external loudspeaker position tracking component 740 is configured to track a position of the external loudspeaker (e.g., loudspeaker(s) 112 corresponding to the far-end speech) over time based on the highest signal quality metric values detected during far-end single-talk conditions. Thus, the external loudspeaker position tracking component 740 may output a reference position 742 to the ARA reference beam selection 640 and the ST/DT state decision component 760.

In some examples, the ARA reference beam selection component 640 may send the reference position 742 to the beam level based target beam selection 730, although the disclosure is not limited thereto. Additionally or alternatively, the ARA reference beam selection component 640 may send an indication of the reference signal(s) to the beam level based target beam selection 730. Thus, the ARA reference beam selection component 640 may send the reference position 742, an indication of the reference signal(s) to the beam level based target beam selection 730, and/or additional data to the ARA reference beam selection 640 without departing from the disclosure. While not illustrated in FIG. 7B, in some examples the external loudspeaker position tracking component 740 may send the reference position 742 directly to the beam level based target beam selection component 730 without departing from the disclosure.

Similarly, the near-end talker position tracker component 750 operates similar to the near-end talker position learning component 680 described above with regard to FIG. 6B. For example, the near-end talker position learning component 680 is configured to track a position of the near-end talker (e.g., local user corresponding to the near-end speech) over time based on the highest signal quality metric values detected during near-end single-talk conditions. Thus, the near-end talker position tracker component 750 may output a target position 752 to the beam level based target beam selection component 730 and the ST/DT state decision component 760.

The ST/DT state decision component 760 may receive input from the external loudspeaker position tracking component 740, the near-end talker position tracker component 750, and/or any detectors included in the double-talk detection component 130, such as the LMS adaptive filter or the near-end single-talk detector described briefly above with regard to FIG. 1 and described in greater detail below with regard to FIGS. 8A-8B. The ST/DT state decision component 760 may determine the current system conditions and generate the decision data 650. While FIG. 7B provides context indicating potential implementations of the double-talk detector component 130 within the ARA algorithm, FIGS. 8A-8B provides a more detailed description of how the double-talk detector component 130 may operate.

Figure 8A:
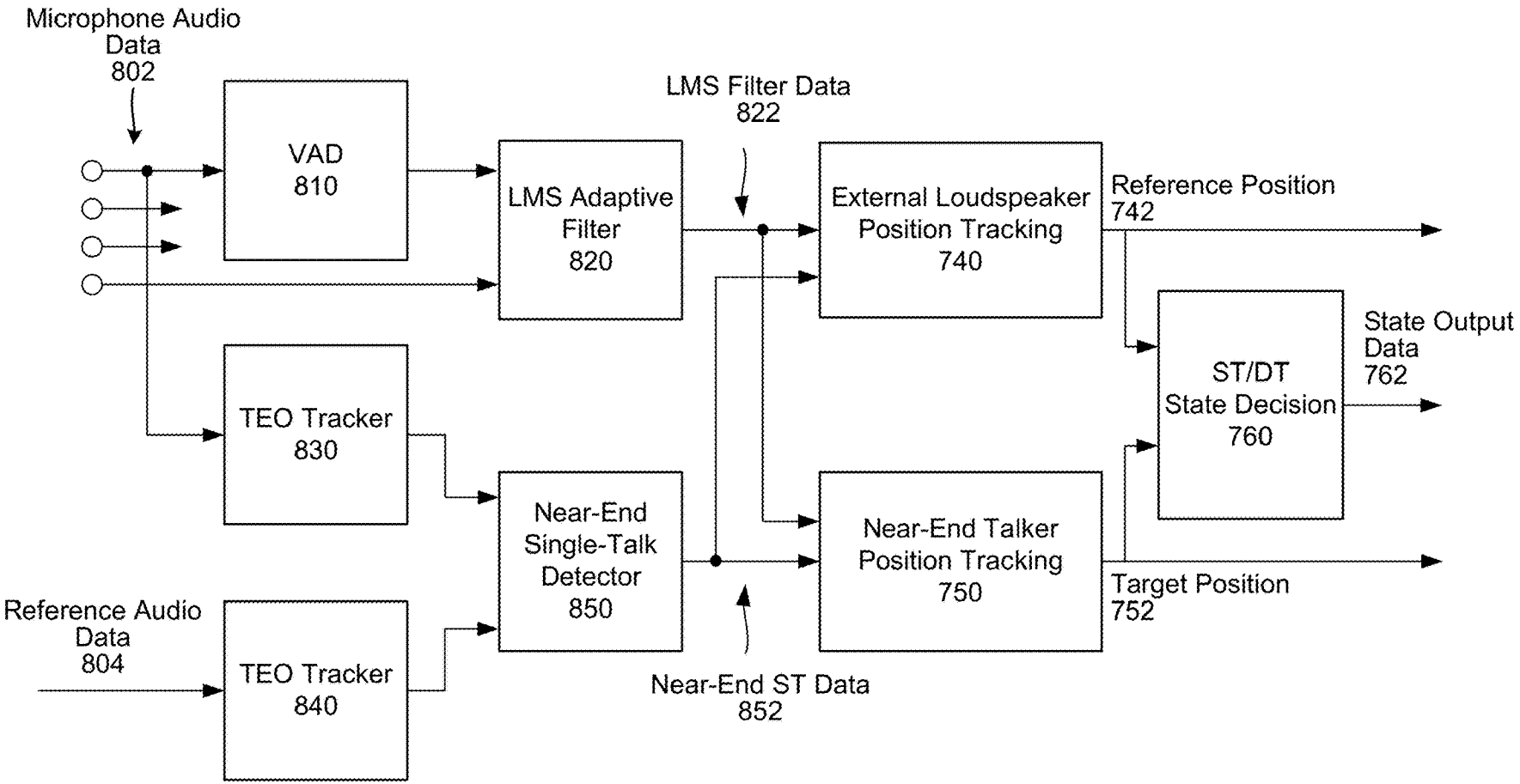
FIGS. 8A-8B illustrate example components for performing double-talk detection and position tracking according to examples of the present disclosure.
Figure 8B:
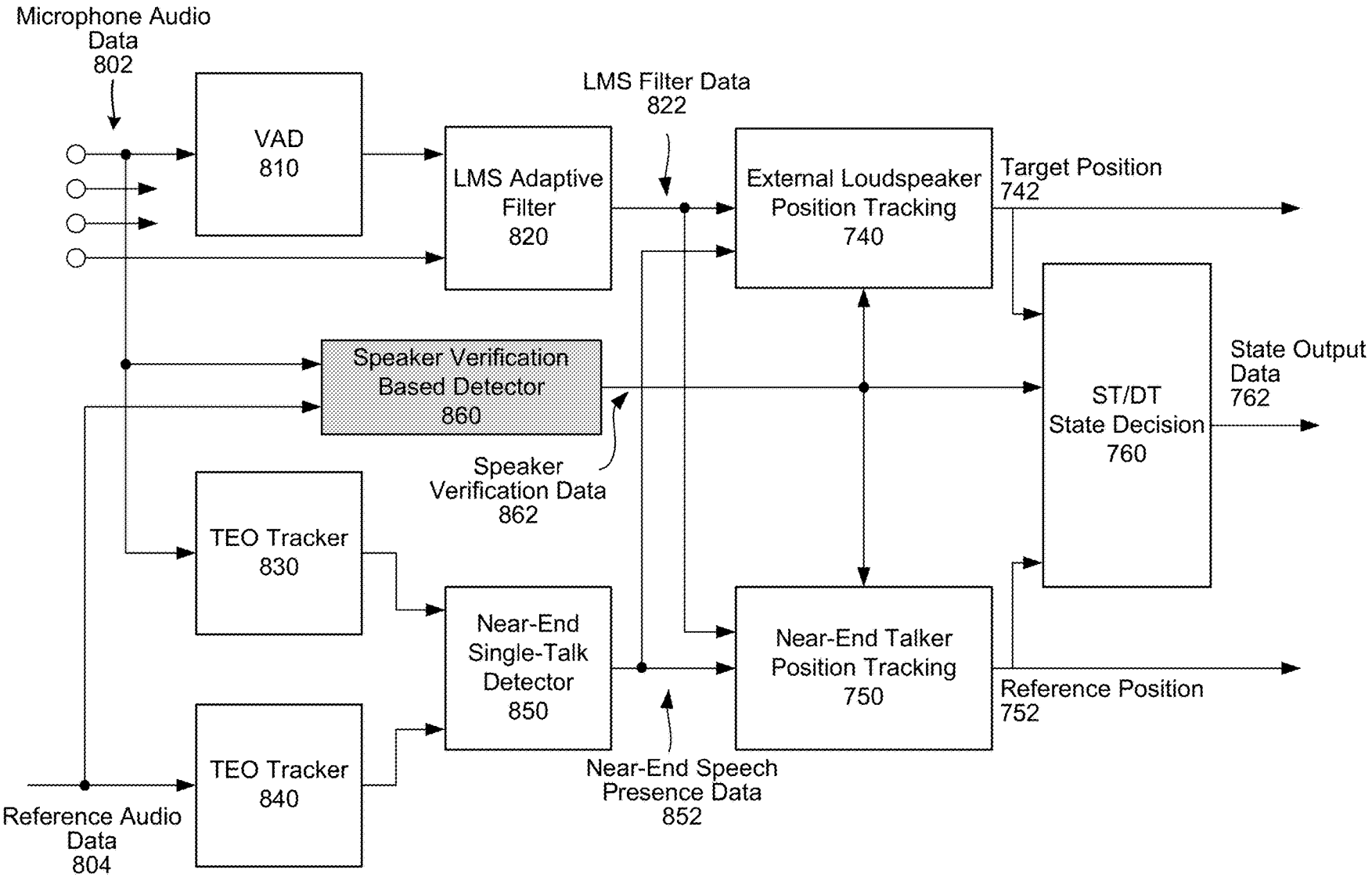

FIGS. 8A-8B illustrate example components for performing double-talk detection and position tracking according to examples of the present disclosure. As illustrated in FIG. 8A, microphone audio data 802 and reference audio data 804 may be input to the double-talk detection component 130 and may be sent to one or more detectors within the double-talk detection component 130. For example, a portion of the microphone audio data 802 (e.g., at least two input channels from the microphone audio data 802, although the disclosure is not limited thereto) may be input to a first detector that includes a voice activity detector (VAD) component 810 and a least means square (LMS) adaptive filter component 820. Additionally or alternatively, a portion of the microphone audio data 802 (e.g., a single input channel) and the reference audio data 804 may be input to a second detector that includes a first Teager energy operator (TEO) tracker component 830, a second TEO tracker component 840, and a near-end single-talk detector component 850.

The first detector may receive a portion of the microphone audio data 802 and may perform VAD using the VAD component 810. When speech is detected in the microphone audio data 802, the VAD component 810 may pass a portion of microphone audio data 802 corresponding to the speech to the LMS adaptive filter component 820. The LMS adaptive filter component 820 may perform AIC processing using a first microphone signal as a target signal and a second microphone signal as a reference signal. As part of performing AIC processing, the LMS adaptive filter component 820 may adapt filter coefficient values to minimize an output of the LMS adaptive filter component 820.

The device 110 may analyze the LMS filter coefficient data to determine a number of peaks represented in the LMS filter coefficient data as well as location(s) of the peak(s). For example, individual filter coefficients of the LMS adaptive filter component 820 may correspond to a time of arrival of the audible sound, enabling the device 110 to determine the direction of an audio source relative to the device 110. Thus, the LMS adaptive filter component 820 may output LMS filter data 822, which may include the LMS filter coefficient data, the number of peaks, and/or the location(s) of the peak(s). The LMS filter data 822 may be sent to the external loudspeaker position tracking component 740, the near-end talker position tracking component 750, and/or the ST/DT state decision component 760.

Based on the LMS filter data 822, the double-talk detection component 130 may determine current system conditions (e.g., near-end single-talk conditions, far-end single-talk conditions, or double-talk conditions). For example, the double-talk detection component 130 may distinguish between single-talk conditions and double-talk conditions based on a number of peaks represented in the LMS filter coefficient data. Thus, a single peak corresponds to single-talk conditions, whereas two or more peaks may correspond to double-talk conditions.

The second detector may determine whether far-end speech is present in the microphone audio data 802 using the first TEO tracker component 830, the second TEO tracker component 840, and/or the near-end single-talk detector component 850. As illustrated in FIG. 8A, the first TEO tracker component 830 may determine first data (e.g., a value, a plurality of values, or the like) associated with the microphone audio data 802, the second TEO tracker component 840 may determine second data (e.g., a value, a plurality of values, or the like) associated with the reference audio data 804, and the near-end single-talk detector component 850 may analyze the first data and the second data to determine whether the far-end speech is present in the microphone audio data 802. For example, the near-end single-talk detector component 850 may determine that far-end speech is present when the first data is strongly correlated to the second data, but may determine that far-end speech is not present when the first data is weakly correlated to the second data.

When the near-end single-talk detector component 850 determines that the far-end speech is not present in the microphone audio data 802, the near-end single-talk detector component 850 may output near-end single-talk (ST) data 852 that indicates that near-end single-talk conditions are present. Thus, the double-talk detection component 130 may determine that near-end single-talk conditions are present regardless of a number of peaks represented in the LMS filter data 822 (e.g., a single peak indicates a single user local to the device 110, whereas multiple peaks indicates multiple users local to the device 110). However, when the device 110 determines that far-end speech is present in the microphone audio data 802, the near-end single-talk detector component 850 may output near-end single-talk (ST) data 852 that indicates that near-end single-talk conditions are not present. Thus, the double-talk detection component 130 may distinguish between far-end single-talk conditions (e.g., a single peak represented in the LMS filter coefficient data) and double-talk conditions (e.g., two or more peaks represented in the LMS filter coefficient data) using the LMS filter data 822.

As illustrated in FIG. 8A, the external loudspeaker position tracking component 740 may receive the LMS filter data 822 from the LMS adaptive filter component 820 and the near-end single-talk data 852 from the near-end single-talk detector component 850. The external loudspeaker position tracking component 740 may analyze the LMS filter data 822 and the near-end single-talk data 852 to determine a reference position 742 and may output the reference position 742 to the ST/DT state decision 760 and/or additional components not illustrated in FIG. 8A.

Similarly, the near-end talker position tracking component 750 may receive the LMS filter data 822 from the LMS adaptive filter component 820 and the near-end single-talk data 852 from the near-end single-talk detector component 850. The near-end talker position tracking component 750 may analyze the LMS filter data 822 and the near-end single-talk data 852 to determine a target position 752 and may output the target position 752 to the ST/DT state decision 760 and/or additional components not illustrated in FIG. 8A.

While not illustrated in FIG. 8A, the external loudspeaker position tracking component 740 may output the reference position 742 to the near-end talker position tracking component 750 and/or the near-end talker position tracking component 750 may output the target position 752 to the external loudspeaker position tracking component 740 without departing from the disclosure.

As illustrated in FIG. 8A, the ST/DT state decision component 760 may receive the reference position 742 and the target position 752 and may generate state output data 762. While not illustrated in FIG. 8A, the ST/DT state decision component 760 may also receive the LMS filter data 822, the near-end ST data 852, and/or additional data without departing from the disclosure. Thus, the ST/DT state decision component 760 may take into account a variety of outputs from two or more detectors to determine the state output data 762. Additionally or alternatively, while not illustrated in FIG. 8A, the ST/DT state decision component 760 may send a portion of the state output data 762 to the external loudspeaker position tracking component 740 and/or the near-end talker position tracking component 750 without departing from the disclosure.

In some examples, the double-talk detection component 130 may include one or more neural networks or other machine learning techniques. For example, the ST/DT state decision component 760, the LMS adaptive filter component 820, the near-end single-talk detector component 850, and/or other components of the double-talk detection component 130 may include a deep neural network (DNN) and/or the like.

Various machine learning techniques may be used to train and operate models to perform various steps described above, such as user recognition feature extraction, encoding, user recognition scoring, etc. Models may be trained and operated according to various machine learning techniques. Such techniques may include, for example, neural networks (such as deep neural networks and/or recurrent neural networks), inference engines, trained classifiers, etc. Examples of trained classifiers include Support Vector Machines (SVMs), neural networks, decision trees, AdaBoost (short for "Adaptive Boosting") combined with decision trees, and random forests. Focusing on SVM as an example, SVM is a supervised learning model with associated learning algorithms that analyze data and recognize patterns in the data, and which are commonly used for classification and regression analysis. Given a set of training examples, each marked as belonging to one of two categories, an SVM training algorithm builds a model that assigns new examples into one category or the other, making it a non-probabilistic binary linear classifier. More complex SVM models may be built with the training set identifying more than two categories, with the SVM determining which category is most similar to input data. An SVM model may be mapped so that the examples of the separate categories are divided by clear gaps. New examples are then mapped into that same space and predicted to belong to a category based on which side of the gaps they fall on. Classifiers may issue a "score" indicating which category the data most closely matches. The score may provide an indication of how closely the data matches the category.

In order to apply the machine learning techniques, the machine learning processes themselves need to be trained. Training a machine learning component such as, in this case, one of the first or second models, requires establishing a "ground truth" for the training examples. In machine learning, the term "ground truth" refers to the accuracy of a training set's classification for supervised learning techniques. Various techniques may be used to train the models including backpropagation, statistical learning, supervised learning, semi-supervised learning, stochastic learning, or other known techniques.

FIG. 8B illustrates an example of including additional double-talk detectors in the double-talk detection component 130. As illustrated in FIG. 8B, a speaker verification based detector component 860 may receive microphone audio data 802 and reference audio data 804 and may generate speaker verification data 862. For example, the speaker verification based detector component 860 may generate a remote speaker model adapted or modeled using the remote speech. When the speaker verification based detector component 860 detects speech represented in the microphone audio data 802, the speaker verification based detector component 860 may compare the detected speech to the remote speaker model and to a universal speaker model and determine whether local speech is present, remote speech is present, or both local speech and remote speech are present. The speaker verification based detector component 860 may optionally generate a local speaker model adapted or modeled using the local speech in addition to the universal model. The speaker verification based detector component 860 may generate speaker verification data 862 indicating the current system conditions (e.g., near-end single-talk, far-end single-talk, or double-talk) and may send the speaker verification data 862 to the external loudspeaker position tracking component 740, the near-end talker position tracking component 750, and/or the ST/DT state decision component 760.

While FIG. 8B illustrates an example in which the speaker verification based detector component 860 is included in the double-talk detection component 130, the disclosure is not limited thereto and the double-talk detection component 130 may include any number of double-talk detector components without departing from the disclosure. For example, the double-talk detection component 130 may include four or more double-talk detector components without departing from the disclosure, with each additional detector component sending data to the external loudspeaker position tracking component 740, the near-end talker position tracking component 750, and/or the ST/DT state decision component 760.

Additionally or alternatively, while FIG. 8B illustrates the double-talk detection component 130 including the LMS adaptive filter component 820 and the near-end single-talk detector component 850, the disclosure is not limited thereto. Instead, the double-talk detection component 130 may omit one of or both of these components without departing from the disclosure. Thus, the double-talk detection component 130 may include one or more double-talk detector components without departing from the disclosure.

In some examples, the ST/DT state decision component 760 may generate state output data 762 that indicates current system conditions (e.g., near-end single-talk conditions, far-end single-talk conditions, or double-talk conditions). Thus, the double-talk detection component 130 may indicate the current system conditions to the beam level based target beam selection component 730, the ARA reference beam selection component 640, the AIC component 120, and/or additional components of the device 110. However, the disclosure is not limited thereto and the double-talk detection component 130 may generate state output data 762 indicating additional information without departing from the disclosure. For example, in some examples, the state output data 762 may include the reference position 742 and/or the target position 752 without departing from the disclosure. Additionally or alternatively, the state output data 762 may indicate the current system conditions, a number of peak(s) represented in the LMS filter coefficient data, and/or the location(s) of the peak(s). Whether included in the state output data 762 or not, the decision data 650 illustrated in FIGS. 6A-7B may include any combination of the above-mentioned data without departing from the disclosure.

To illustrate a first example, when the device 110 determines that far-end speech is not present, the double-talk detection component 130 may generate decision data 650 indicating that near-end single-talk conditions are present along with direction(s) associated with local speech generated by one or more local users. For example, if the double-talk detection component 130 determines that only a single peak is represented during a first duration of time, the double-talk detection component 130 may determine a first direction associated with a first user during the first duration of time. However, if the double-talk detection component 130 determines that two peaks are represented during a second duration of time, the double-talk detection component 130 may determine the first direction associated with the first user and a second direction associated with a second user. In addition, the double-talk detection component 130 may track the users over time and/or associate a particular direction with a particular user based on previous local speech during near-end single-talk conditions.

To illustrate a second example, when the device 110 determines that far-end speech is present, the double-talk detection component 130 may generate decision data 650 indicating system conditions (e.g., far-end single talk conditions or double-talk conditions), along with a number of peak(s) represented in the LMS filter coefficient data and/or location(s) associated with the peak(s). For example, if the double-talk detection component 130 determines that only a single peak is represented in the LMS filter coefficient data during a third duration of time, the double-talk detection component 130 may generate decision data 650 indicating that far-end single-talk conditions are present and identifying a third direction associated with the loudspeaker 114 outputting the far-end speech during the third duration of time. However, if the double-talk detection component 130 determines that two or more peaks are represented in the LMS filter coefficient data during a fourth duration of time, the double-talk detection component 130 may generate decision data 650 indicating that double-talk conditions are present, identifying the third direction associated with the loudspeaker 114, and identifying a fourth direction associated with a local user. In addition, the double-talk detection component 130 may track the loudspeaker 114 over time and/or associate a particular direction with the loudspeaker 114 based on previous far-end single-talk conditions.

As the double-talk detection component 130 may track first direction(s) associated with local users during near-end single-talk conditions and second direction(s) associated with the loudspeaker(s) 114 during far-end single-talk conditions, the double-talk detection component 130 may determine whether double-talk conditions are present in part based on the locations of peaks represented in the LMS filter coefficient data. For example, the double-talk detection component 130 may determine that two peaks are represented in the LMS filter coefficient data but that both locations were previously associated with local users during near-end single-talk conditions. Therefore, the double-talk detection component 130 may determine that near-end single-talk conditions are present. Additionally or alternatively, the double-talk detection component 130 may determine that two peaks are represented in the LMS filter coefficient data but that one location was previously associated with the loudspeaker 114 during far-end single-talk conditions. Therefore, the double-talk detection component 130 may determine that double-talk conditions are present In some examples, the ARA target beam selection component 630 may select the target beam(s) based on location data (e.g., location(s) associated with near-end speech, such as a local user) included in the detection data 650 received from the double-talk detection component 130. However, the disclosure is not limited thereto and the ARA target beam selection component 630 may select the target beam(s) using techniques known to one of skill in the art without departing from the disclosure. For example, the ARA target beam selection component 630 may detect local speech represented in the beamformed audio data, may track a direction associated with a user (e.g., identify direction(s) associated with near-end single-talk conditions), may determine the direction associated with the user using facial recognition, and/or the like without departing from the disclosure.

In some examples, the ARA reference beam selection component 640 may select the reference beam(s) based on location data (e.g., location(s) associated with far-end speech, such as the loudspeaker(s) 114 outputting the far-end speech) included in the detection data 650 received from the double-talk detection component 130. However, the disclosure is not limited thereto and the ARA reference beam selection component 640 may select the reference beam(s) using techniques known to one of skill in the art without departing from the disclosure. For example, the ARA reference beam selection component 640 may detect remote speech represented in the beamformed audio data, may track a direction associated with a loudspeaker 114 (e.g., identify direction(s) associated with far-end single-talk conditions), may determine the direction associated with the loudspeaker(s) 114 using computer vision processing, and/or the like without departing from the disclosure.

In order to avoid selecting an output of the loudspeaker(s) 114 as a target signal, the ARA target beam selection component 630 may dynamically select the target beam(s) only during near-end single-talk conditions. Thus, the ARA target beam selection component 630 may freeze target beam selection and store the currently selected target beam(s) when the device 110 determines that far-end single-talk conditions and/or double-talk conditions are present (e.g., the device 110 detects far-end speech). For example, if the ARA target beam selection component 630 selects a first direction (e.g., Direction 1) as the target beam during near-end single-talk conditions, the ARA target beam selection component 630 may store the first direction as the target beam during far-end single-talk conditions and/or double-talk conditions, such that the target signal(s) correspond to beamformed audio data associated with the first direction. Thus, the target beam(s) remain fixed (e.g., associated with the first direction) whether the target signal(s) represent local speech (e.g., during double-talk conditions) or not (e.g., during far-end single-talk conditions).

Similarly, in order to avoid selecting the local speech as a reference signal, the ARA reference beam selection component 640 may select the reference beam(s) only during far-end single-talk conditions. Thus, the ARA reference beam selection component 640 may freeze reference beam selection and store the currently selected reference beam(s) when the device 110 determines that near-end single-talk conditions and/or double-talk conditions are present (e.g., the device 110 detects near-end speech). For example, if the ARA reference beam selection component 640 selects a fifth direction (e.g., Direction 5) as the reference beam during far-end single-talk conditions, the ARA reference beam selection component 640 may store the fifth direction as the reference beam during near-end single-talk conditions and/or double-talk conditions, such that the reference signal(s) correspond to beamformed audio data associated with the fifth direction. Thus, the reference beam(s) remain fixed (e.g., associated with the fifth direction) whether the reference signal(s) represent remote speech (e.g., during double-talk conditions) or not (e.g., during near-end single-talk conditions).

To illustrate an example, in response to the device 110 determining that near-end single-talk conditions are present, the ARA reference beam selection component 640 may store previously selected reference beam(s) and the ARA target beam selection component 630 may dynamically select target beam(s) using the beamformed audio data output by the FBF 620. While the near-end single-talk conditions are present, the AIC component 120 may generate an output signal 660 by subtracting reference signal(s) corresponding to the fixed reference beam(s) from target signal(s) corresponding to the dynamic target beam(s). If the device 110 determines that double-talk conditions are present, the ARA target beam selection component 630 may store the previously selected target beam(s) and the AIC component 120 may generate the output signal 660 by subtracting reference signal(s) corresponding to the fixed reference beam(s) from target signal(s) corresponding to the fixed target beam(s). Finally, if the device 110 determining that far-end single-talk conditions are present, the ARA reference beam selection component 640 may dynamically select reference beam(s) using the beamformed audio data output by the FBF 620. Thus, the far-end single-talk conditions are present, the AIC component 120 may generate the output signal 660 by subtracting reference signal(s) corresponding to the dynamic reference beam(s) from target signal(s) corresponding to the fixed target beam(s).

FIGS. 9A-9B illustrate examples of determining system conditions according to examples of the present disclosure. As shown by decision chart 910 illustrated in FIG. 9A, the device 110 may determine system conditions based on a number of peaks represented in the LMS filter coefficient data. For example, if there are zero peaks represented in the LMS filter coefficient data, the device 110 may determine that silence is detected (e.g., no-speech conditions 220). In contrast, if there is one peak represented in the LMS filter coefficient data, the device 110 may determine that single-talk conditions are present. Finally, if there are two peaks represented in the LMS filter coefficient data, the device 110 may determine that double-talk conditions are present. As the device 110 may apply different parameters depending on whether far-end single-talk conditions are present or double-talk conditions are present, distinguishing between single-talk conditions and double-talk conditions improves the output audio data generated by the device 110.

In some examples, the double-talk detection component 130 may receive additional input indicating whether the far-end speech is present. For example, the device 110 may separately determine whether the far-end signal is active and/or whether far-end speech is present in the microphone audio data using various techniques known to one of skill in the art. As illustrated in FIG. 9B, this additional information is illustrated as additional context data 922, which indicates either "no far-end speech" (e.g., far-end speech is not present in the microphone audio data) or "far-end speech" (e.g., far-end speech is present in the microphone audio data). The additional context data 922 may correspond to the near-end speech presence data 852, although the disclosure is not limited thereto.

In addition, FIG. 9B illustrates decision chart 920, which represents potential system conditions based on the additional context data 922 and the number of peak(s) detected in the LMS filter coefficient data.

Regardless of whether far-end speech is present or not, no peaks represented in the LMS filter coefficient data corresponds to silence being detected (e.g., no-speech conditions 220). Additionally or alternatively, the device 110 may perform voice activity detection (VAD) and/or include a VAD detector to determine that no-speech conditions 220 are present (e.g., speech silence) without departing from the disclosure.

When the device 110 determines that far-end speech is not present, the double-talk detection component 130 may generate decision data indicating that near-end single-talk conditions are present along with direction(s) associated with local speech generated by one or more local users. For example, if the double-talk detection component 130 determines that only a single peak is represented in the LMS filter coefficient data, the double-talk detection component 130 may determine a first direction associated with a first user. However, if the double-talk detection component 130 determines that two peaks are represented in the LMS filter coefficient data, the double-talk detection component 130 may determine the first direction associated with the first user and a second direction associated with a second user. In addition, the double-talk detection component 130 may track the users over time and/or associate a particular direction with a particular user based on previous local speech during near-end single-talk conditions.

When the device 110 determines that far-end speech is present, the double-talk detection component 130 may generate decision data indicating system conditions (e.g., far-end single talk conditions or double-talk conditions), along with a number of peak(s) represented in the LMS filter coefficient data and/or location(s) associated with the peak(s). For example, if the double-talk detection component 130 determines that only a single peak is represented in the LMS filter coefficient data, the double-talk detection component 130 may generate decision data indicating that far-end single-talk conditions are present and identifying a third direction associated with the loudspeaker 114 outputting the far-end speech. However, if the double-talk detection component 130 determines that two or more peaks are represented in the LMS filter coefficient data, the double-talk detection component 130 may generate decision data indicating that double-talk conditions are present, identifying the third direction associated with the loudspeaker 114, and identifying a fourth direction associated with a local user (e.g., the first direction associated with the first user, the second direction associated with the second user, or a new direction associated with an unidentified user). In addition, the double-talk detection component 130 may track the loudspeaker 114 over time and/or associate a particular direction with the loudspeaker 114 based on previous far-end single-talk conditions.

Thus, the double-talk detection component 130 may generate decision data that indicates the current system conditions, a number of peak(s) represented in the LMS filter coefficient data, and/or the location(s) of the peak(s). If the double-talk detection component 130 determines that near-end single-talk conditions are present, the number of peak(s) correspond to the number of local users generating local speech and the location(s) of the peak(s) correspond to individual locations for each local user speaking. Additionally or alternatively, if the double-talk detection component 130 determines that far-end single-talk conditions are present, the number of peak(s) correspond to the number of loudspeaker(s) 114 (typically only one, although the disclosure is not limited thereto) outputting the far-end speech and the location(s) of the peak(s) correspond to individual locations for each loudspeaker 114. Finally, if the double-talk detection component 130 determines that double-talk conditions are present, the number of peaks correspond to a sum of a first number of local users generating local speech and a second number of loudspeaker(s) 114 outputting the far-end speech, and the location(s) of the peak(s) correspond to individual locations for each of the local users and/or loudspeaker 114.

As the double-talk detection component 130 tracks the location of the local users and/or the loudspeaker(s) 114 over time, the double-talk detection component 130 may associate individual peaks with a likely source (e.g., first peak centered on filter coefficient 13 corresponds to a local user, while second peak centered on filter coefficients 16-17 correspond to the loudspeaker 114, etc.).

In some examples, the device 110 may output the far-end reference signal x(t) only to a single loudspeaker 114. Thus, the device 110 may determine when double-talk conditions are present whenever the far-end speech is detected and two or more peaks are represented in the LMS filter coefficient data. By tracking a location of the loudspeaker 114 during far-end single-talk conditions, the device 110 may identify location(s) of one or more user(s) during the double-talk conditions. However, the disclosure is not limited thereto and in other examples, the device 110 may output the far-end reference signal x(t) to two or more loudspeakers 114. For example, if the device 110 outputs the far-end reference signal x(t) to two loudspeakers 114, the device 110 may determine when double-talk conditions are present whenever the far-end speech is detected and three or more peaks are represented in the LMS filter coefficient data. By tracking a location of the loudspeakers 114 during the far-end single-talk conditions, the device 110 may identify location(s) of one or more user(s) during the double-talk conditions.

Figure 10:
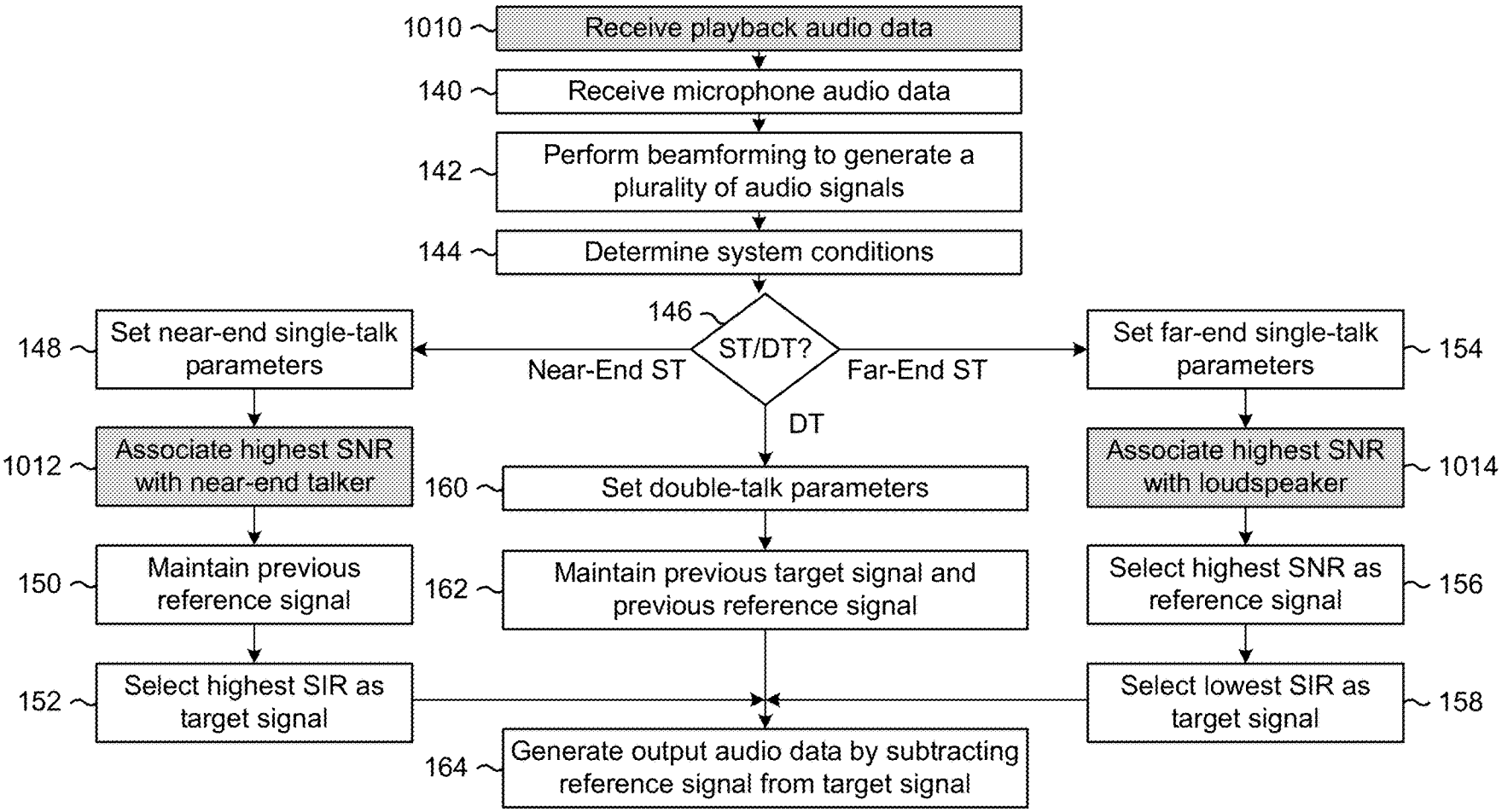
FIG. 10 is a flowchart conceptually illustrating an example method for performing echo cancellation according to embodiments of the present disclosure.

FIG. 10 is a flowchart conceptually illustrating an example method for performing echo cancellation according to embodiments of the present disclosure. As many of the steps illustrated in FIG. 10 are identical to FIG. 1, redundant descriptions are omitted for ease of illustration. As illustrated in FIG. 10, the device 110 may receive (1010) playback audio data prior to receiving the microphone audio data in step 140. For example, the device 110 may receive the playback audio data sent to the loudspeaker(s) 114, which may correspond to reference audio data 702 and/or reference audio data 804 used by the double-talk detection component 130.

In addition, after setting near-end single-talk parameters in step 148, the device 110 may associate (1012) a highest signal-to-noise ratio (SNR) value with the near-end talker. For example, the device 110 may determine an SNR value for each of the plurality of signals (e.g., beamformed audio data output by the FBF component 620) and may select a signal (e.g., beam) associated with the highest SNR value as being associated with the near-end talker. In some examples, this signal and/or a direction associated with this signal may be stored in the near-end talker position tracking component 750.

Similarly, after setting far-end single-talk parameters in step 154, the device 110 may associate (1014) a highest signal-to-noise ratio (SNR) value with the loudspeaker(s) 114. For example, the device 110 may determine an SNR value for each of the plurality of signals (e.g., beamformed audio data output by the FBF component 620) and may select a signal (e.g., beam) associated with the highest SNR value as being associated with the loudspeaker(s) 114. In some examples, this signal and/or a direction associated with this signal may be stored in the external loudspeaker position tracking component 740.

Figure 11:
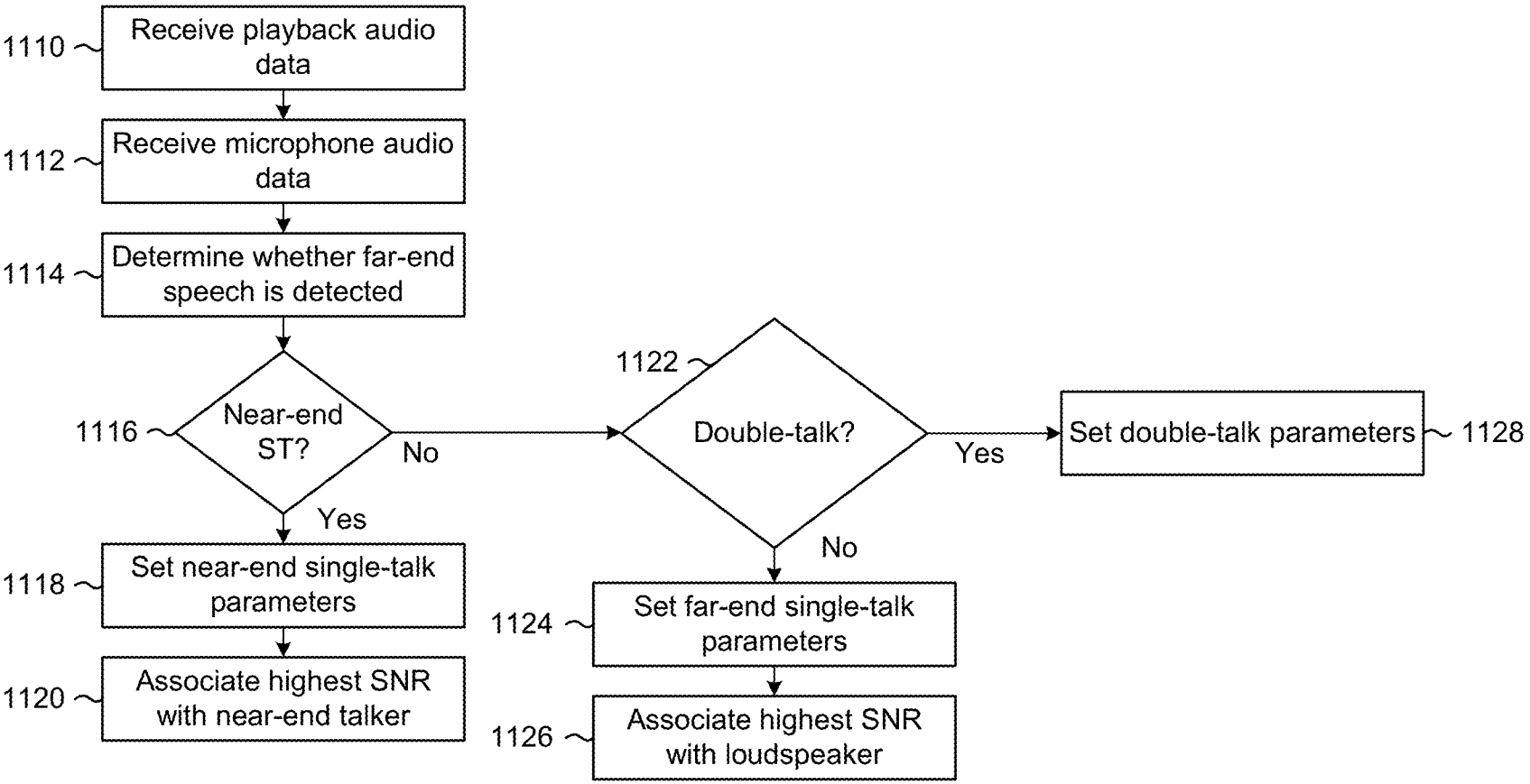
FIG. 11 is a flowchart conceptually illustrating an example method for performing double-talk detection according to embodiments of the present disclosure.

FIG. 11 is a flowchart conceptually illustrating an example method for performing double-talk detection according to embodiments of the present disclosure. As illustrated in FIG. 11, the device 110 may receive (1110) playback audio data, may receive (1112) microphone audio data and may determine (1114) whether far-end speech is detected in the microphone audio data.

The device 110 may determine (1116) whether near-end single-talk conditions are present based on whether the far-end speech is detected. For example, if the far-end speech is not detected, the device 110 may set (1118) near-end single-talk parameters and associate (1120) a highest SNR value with the near-end talker, as described in greater detail above with regard to step 1012. However, if the far-end speech is detected, the device 110 may determine (1122) whether double-talk conditions are detected. If double-talk conditions are not detected (e.g., no local speech is detected), the device 110 may set (1124) far-end single-talk parameters and may associate (1126) the highest SNR value with the loudspeaker, as described in greater detail above with regard to step 1014. If double-talk conditions are detected, the device 110 may set (1128) double-talk parameters.

Figure 12:
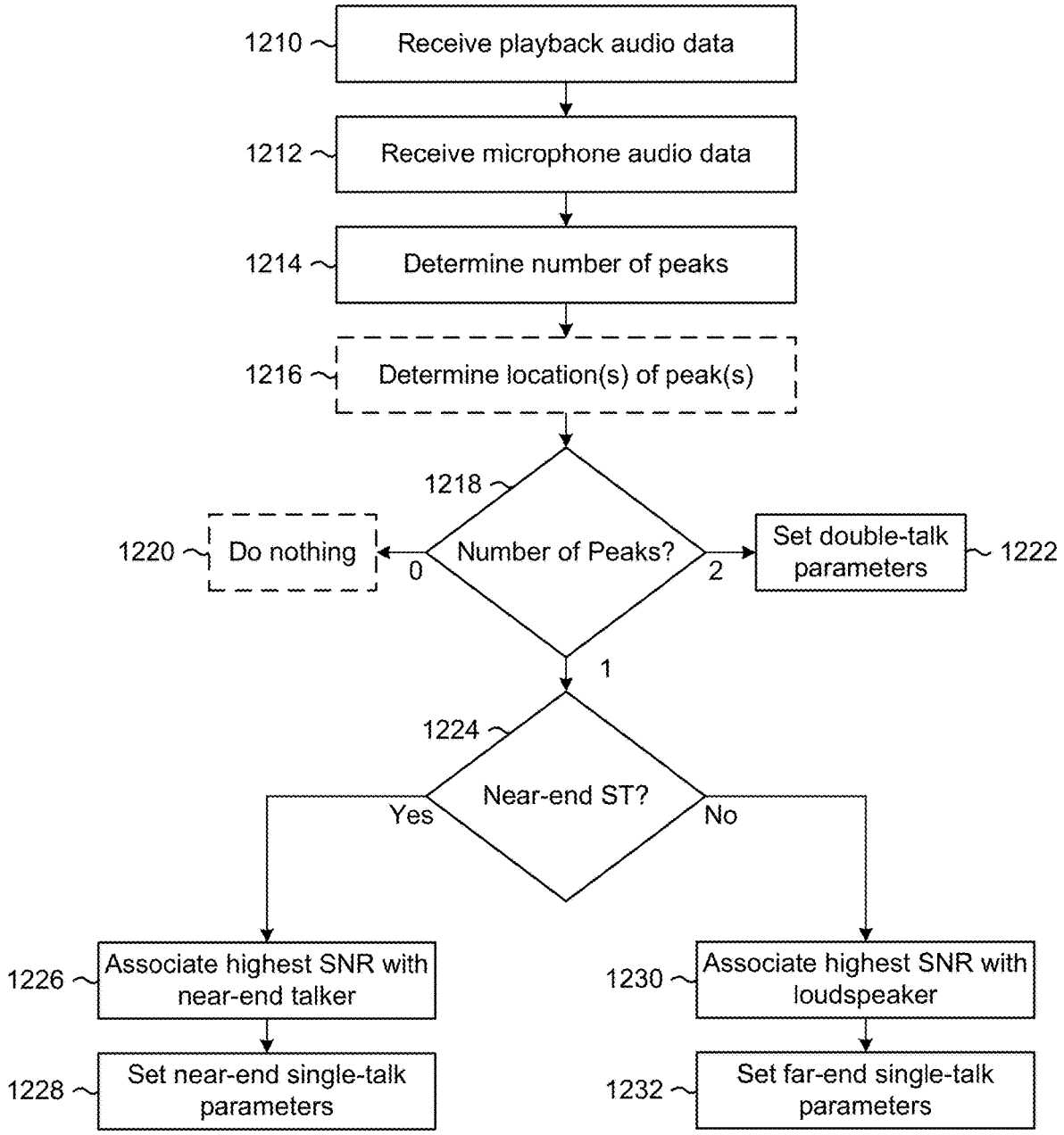
FIG. 12 is a flowchart conceptually illustrating an example method for performing double-talk detection and position tracking according to embodiments of the present disclosure.

FIG. 12 is a flowchart conceptually illustrating an example method for performing double-talk detection and position tracking according to embodiments of the present disclosure. As illustrated in FIG. 12, the device 110 may receive (1210) playback audio data, may receive (1212) microphone audio data, may determine (1214) a number of peaks using the LMS adaptive filter component described above, and may optionally determine (1216) location(s) of the peak(s) using the LMS adaptive filter component.

The device 110 may determine (1218) whether there are zero peaks, one peak or two peaks. If the device 110 determines that there are zero peaks, the device 110 may do nothing in step 1220, although the disclosure is not limited thereto. If the device 110 determines that there are two peaks, the device 110 may set (1222) double-talk parameters. If the device 110 determines that there is a single peak, the device 110 may determine (1224) whether near-end single-talk conditions are present. If near-end single-talk conditions are present, the device 110 may associate (1226) a highest SNR value with the near-end talker and set (1228) near-end single-talk parameters. However, if near-end single-talk conditions are not present, the device 110 may associate (1230) a highest SNR value with the loudspeaker and may set (1232) far-end single-talk parameters.

Figure 13:
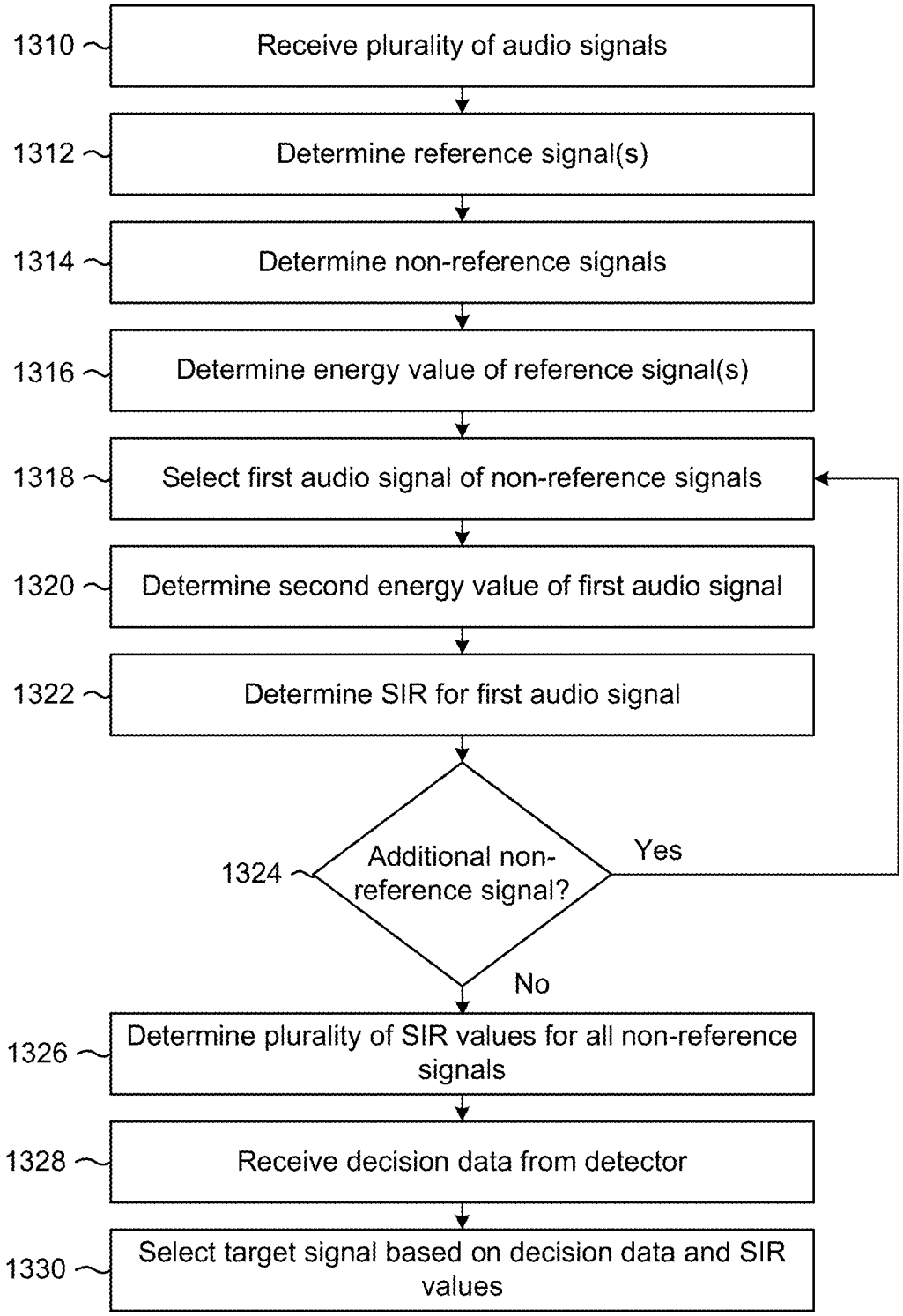
FIG. 13 is a flowchart conceptually illustrating an example method for performing beam level based adaptive target selection according to embodiments of the present disclosure.

FIG. 13 is a flowchart conceptually illustrating an example method for performing beam level based adaptive target selection according to embodiments of the present disclosure. As illustrated in FIG. 13, the device 110 may receive (1310) a plurality of audio signals output from a beamformer (e.g., FBF component 620), determine (1312) reference signal(s) from the plurality of audio signals, determine (1314) non-reference signals from the plurality of audio signals, and determine (1316) an energy value associated with the reference signal(s). For example, the device 110 may determine a first plurality of energy values corresponding to individual frequency bands of the reference signals and may generate the first energy value as a weighted sum of the first plurality of energy values.

The device 110 may select (1318) a first audio signal of the non-reference signals, may determine (1320) a second energy value of the first audio signal, and may determine (1320) a signal-to-interference (SIR) value for the first audio signal. For example, the device 110 may determine a second plurality of energy values corresponding to individual frequency bands of the first audio signal and may generate the second energy value as a weighted sum of the second plurality of energy values. The device 110 may determine the SIR value by dividing the second energy value by the first energy value.

The device 110 may determine (1324) whether there is an additional non-reference signal and, if so, may loop to step 1318 and repeat steps 1318-1322 for the additional non-reference signal until every non-reference signal is processed. If there are no additional non-reference signals, the device 110 may determine (1326) a plurality of SIR values for all non-reference signals, may receive (1328) decision data from a double-talk detector (e.g., double-talk detection component 130, the ST/DT state decision 760, and/or individual double-talk detectors included in the double-talk detection component 130), and may select (1330) a target signal (or target signals) based on the decision data and the SIR values. For example, the device 110 may sort the plurality of SIR values from highest to lowest and may select the highest SIR value when near-end single-talk conditions and/or double-talk conditions are present and may select the lowest SIR value when far-end single-talk conditions are present.

While FIG. 13 and examples described above illustrate that the device 110 selects the target signal based on a highest/lowest SIR value, this is intended for illustrative purposes only and the disclosure is not limited thereto. When near-end single-talk conditions and/or double-talk conditions are present, the device 110 may select the target signal having a highest energy value, whereas when far-end single-talk conditions are present the device 110 may select the target signal having a lowest energy value. Thus, while SIR values are an example of a signal quality metric indicating an energy value, the disclosure is not limited thereto and the device 110 may select the target signal based on the SIR value, a signal-to-noise ratio (SNR) value, other energy values and/or the like without departing from the disclosure.

Figure 14:
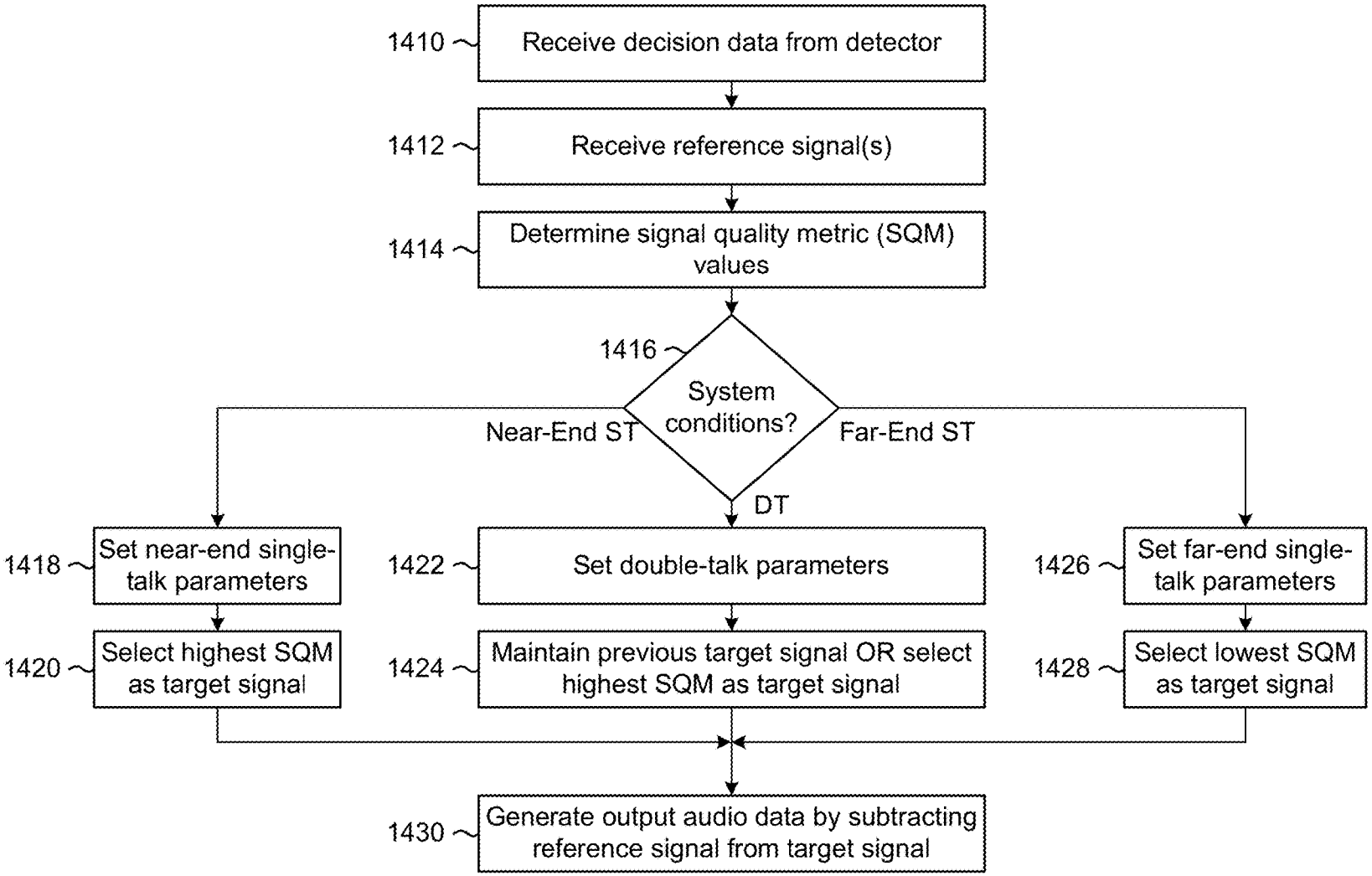
FIG. 14 is a flowchart conceptually illustrating an example method for performing beam level based adaptive target selection according to embodiments of the present disclosure.

FIG. 14 is a flowchart conceptually illustrating an example method for performing beam level based adaptive target selection according to embodiments of the present disclosure. As illustrated in FIG. 14, the device 110 may receive (1410) decision data from a double-talk detector (e.g., double-talk detection component 130, the ST/DT state decision 760, and/or individual double-talk detectors included in the double-talk detection component 130), may receive (1412) reference signal(s), and may determine (1414) signal quality metric (SQM) values.

The device 110 may determine (1416) system conditions based on the decision data. When near-end single-talk conditions are present, the device 110 may set (1418) near-end single-talk parameters and may select (1420) highest SQM values as the target signal. When double-talk conditions are present, the device 110 may set (1422) double-talk parameters, may maintain (1424) previous the target signal (e.g., determined in step 1420) or may select a highest SQM value as the target signal. Thus, in some examples the device 110 may dynamically select the target signal based on the highest SQM value only during near-end single-talk conditions, while in other examples the device 110 may dynamically select the target signal based on the highest SQM value during double-talk conditions as well. Finally, when far-end single-talk conditions are present, the device 110 may set (1426) far-end single-talk parameters and may select (1428) lowest SQM values as the target signal. The device 110 may then generate (1430) output audio data by subtracting the selected reference signal from the selected target signal.

Figure 15:
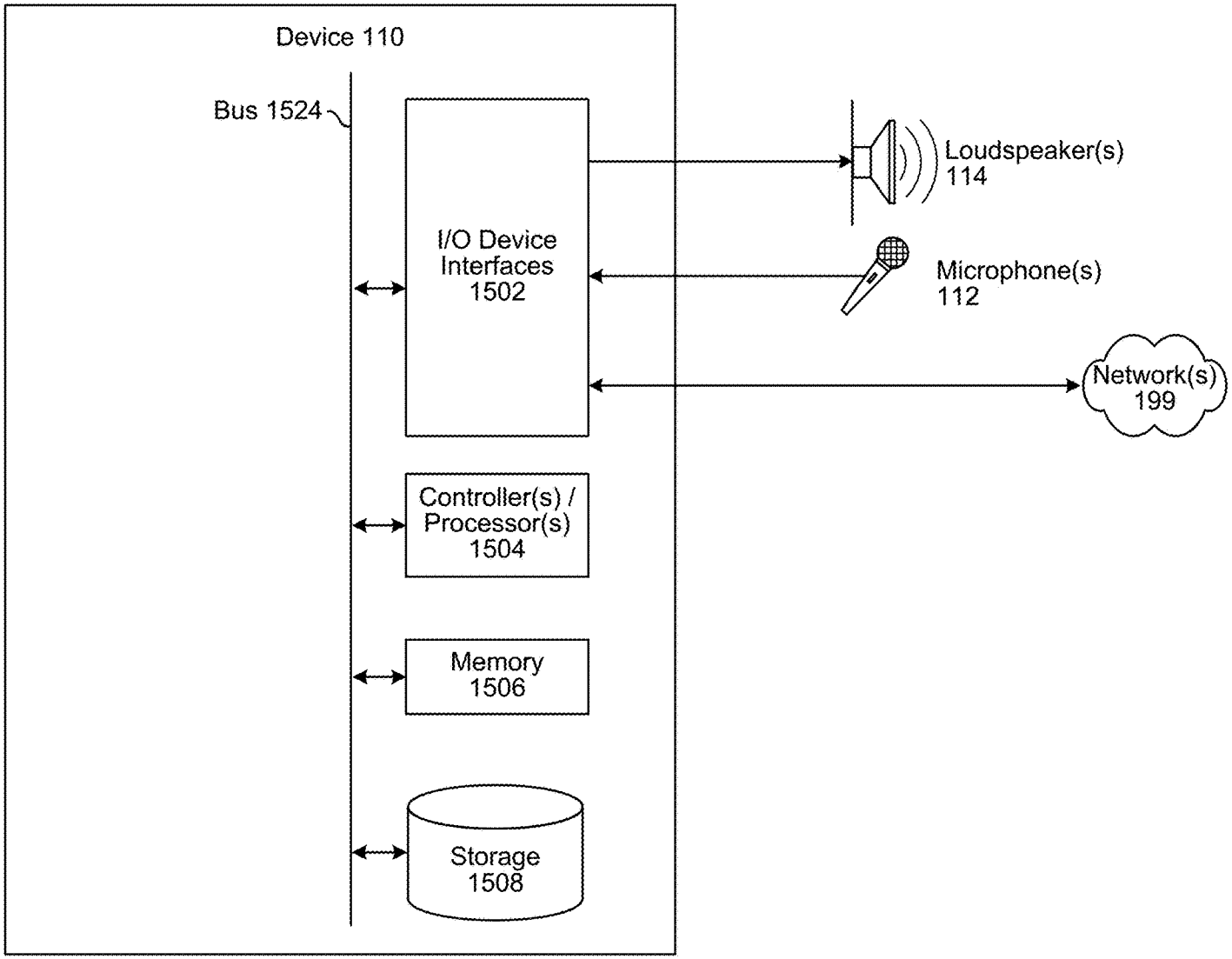
FIG. 15 is a block diagram conceptually illustrating example components of a system according to embodiments of the present disclosure.

FIG. 15 is a block diagram conceptually illustrating example components of a system according to embodiments of the present disclosure. In operation, the system 100 may include computer-readable and computer-executable instructions that reside on the device 110, as will be discussed further below.

The device 110 may include one or more audio capture device(s), such as a microphone array which may include one or more microphones 112. The audio capture device(s) may be integrated into a single device or may be separate. The device 110 may also include an audio output device for producing sound, such as loudspeaker(s) 116. The audio output device may be integrated into a single device or may be separate.

As illustrated in FIG. 15, the device 110 may include an address/data bus 1524 for conveying data among components of the device 110. Each component within the device 110 may also be directly connected to other components in addition to (or instead of) being connected to other components across the bus 1524.

The device 110 may include one or more controllers/processors 1504, which may each include a central processing unit (CPU) for processing data and computer-readable instructions, and a memory 1506 for storing data and instructions. The memory 1506 may include volatile random access memory (RAM), non-volatile read only memory (ROM), non-volatile magnetoresistive (MRAM) and/or other types of memory. The device 110 may also include a data storage component 1508, for storing data and controller/processor-executable instructions (e.g., instructions to perform operations discussed herein). The data storage component 1508 may include one or more non-volatile storage types such as magnetic storage, optical storage, solid-state storage, etc. The device 110 may also be connected to removable or external non-volatile memory and/or storage (such as a removable memory card, memory key drive, networked storage, etc.) through the input/output device interfaces 1502.

The device 110 includes input/output device interfaces 1502. A variety of components may be connected through the input/output device interfaces 1502. For example, the device 110 may include one or more microphone(s) 112 (e.g., a plurality of microphone(s) 112 in a microphone array), one or more loudspeaker(s) 114, and/or a media source such as a digital media player (not illustrated) that connect through the input/output device interfaces 1502, although the disclosure is not limited thereto. Instead, the number of microphone(s) 112 and/or the number of loudspeaker(s) 114 may vary without departing from the disclosure. In some examples, the microphone(s) 112 and/or loudspeaker(s) 114 may be external to the device 110, although the disclosure is not limited thereto. The input/output interfaces 1502 may include A/D converters (not illustrated) and/or D/A converters (not illustrated).

The input/output device interfaces 1502 may also include an interface for an external peripheral device connection such as universal serial bus (USB), FireWire, Thunderbolt, Ethernet port or other connection protocol that may connect to network(s) 199.

The input/output device interfaces 1502 may be configured to operate with network(s) 199, for example via an Ethernet port, a wireless local area network (WLAN) (such as WiFi), Bluetooth, ZigBee and/or wireless networks, such as a Long Term Evolution (LTE) network, WiMAX network, 3G network, etc. The network(s) 199 may include a local or private network or may include a wide network such as the internet. Devices may be connected to the network(s) 199 through either wired or wireless connections.

The device 110 may include components that may comprise processor-executable instructions stored in storage 1508 to be executed by controller(s)/processor(s) 1504 (e.g., software, firmware, hardware, or some combination thereof). For example, components of the device 110 may be part of a software application running in the foreground and/or background on the device 110. Some or all of the controllers/components of the device 110 may be executable instructions that may be embedded in hardware or firmware in addition to, or instead of, software. In one embodiment, the device 110 may operate using an Android operating system (such as Android 4.3 Jelly Bean, Android 4.4 KitKat or the like), an Amazon operating system (such as FireOS or the like), or any other suitable operating system.

Computer instructions for operating the device 110 and its various components may be executed by the controller(s)/processor(s) 1504, using the memory 1506 as temporary "working" storage at runtime. The computer instructions may be stored in a non-transitory manner in non-volatile memory 1506, storage 1508, or an external device. Alternatively, some or all of the executable instructions may be embedded in hardware or firmware in addition to or instead of software.

Multiple devices may be employed in a single device 110. In such a multi-device device, each of the devices may include different components for performing different aspects of the processes discussed above. The multiple devices may include overlapping components. The components listed in any of the figures herein are exemplary, and may be included a stand-alone device or may be included, in whole or in part, as a component of a larger device or system.

The concepts disclosed herein may be applied within a number of different devices and computer systems, including, for example, general-purpose computing systems, server-client computing systems, mainframe computing systems, telephone computing systems, laptop computers, cellular phones, personal digital assistants (PDAs), tablet computers, video capturing devices, wearable computing devices (watches, glasses, etc.), other mobile devices, video game consoles, speech processing systems, distributed computing environments, etc. Thus the components, components and/or processes described above may be combined or rearranged without departing from the ope of the present disclosure. The functionality of any component described above may be allocated among multiple components, or combined with a different component. As discussed above, any or all of the components may be embodied in one or more general-purpose microprocessors, or in one or more special-purpose digital signal processors or other dedicated microprocessing hardware. One or more components may also be embodied in software implemented by a processing unit. Further, one or more of the components may be omitted from the processes entirely.

The above embodiments of the present disclosure are meant to be illustrative. They were chosen to explain the principles and application of the disclosure and are not intended to be exhaustive or to limit the disclosure. Many modifications and variations of the disclosed embodiments may be apparent to those of skill in the art. Persons having ordinary skill in the field of computers and/or digital imaging should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media. Some or all of the fixed beamformer, acoustic echo canceller (AEC), adaptive noise canceller (ANC) unit, residual echo suppression (RES), double-talk detector, etc. may be implemented by a digital signal processor (DSP).

Embodiments of the present disclosure may be performed in different forms of software, firmware and/or hardware. Further, the teachings of the disclosure may be performed by an application specific integrated circuit (ASIC), field programmable gate array (FPGA), or other component, for example.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y and Z," unless specifically stated otherwise, is to be understood with the context as used in general to convey that an item, term, etc. may be either X, Y, or Z, or a combination thereof. Thus, such conjunctive language is not generally intended to imply that certain embodiments require at least one of X, at least one of Y and at least one of Z to each is present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, the method comprising:

receiving, by a local device, playback audio data representing remote speech originating at a remote device;

sending, to a loudspeaker of the local device, the playback audio data to generate output audio;

determining, using a first microphone of the local device, first microphone audio data including a first representation of the remote speech and a first representation of local speech originating at the local device;

determining, using a second microphone of the local device, second microphone audio data including a second representation of the remote speech and a second representation of the local speech;

determining, using at least the first microphone audio data and the second microphone audio data, a plurality of audio signals comprising:

a first audio signal corresponding to a first direction, a second audio signal corresponding to a second direction, and a third audio signal corresponding to a third direction;

determining, by a double-talk detector of the local device, that a first portion of the first microphone audio data includes the first representation of the remote speech but not the first representation of the local speech, the first portion of the first microphone audio data corresponding to a first time range;

selecting one or more first audio signals from the plurality of audio signals as a reference signal, the one or more first audio signals including the third audio signal and corresponding to the remote speech;

determining that one or more second audio signals from the plurality of audio signals are not selected as the reference signal, the one or more second audio signals including the first audio signal and the second audio signal;

determining a first energy value of a first portion of the first audio signal, the first energy value being a first weighted sum of a plurality of frequency ranges of the first portion of the first audio signal within the first time range;

determining a second energy value of a first portion of the second audio signal, the second energy value being a second weighted sum of the plurality of frequency ranges of the first portion of the second audio signal within the first time range;

determining that the first energy value is lower than the second energy value; and generating a first portion of third microphone audio data by subtracting the first portion of the one or more first audio signals from the first portion of the first audio signal, the first portion of the third microphone audio data corresponding to the first time range.

2. The computer-implemented method of claim 1, further comprising:

determining, by the double-talk detector, that a second portion of the first microphone audio data includes the first representation of the local speech, the second portion of the first microphone audio data corresponding to a second time range that occurs after the first time range;

determining that, within the second time range, a second portion of the second audio signal has a highest signal-to-noise ratio (SNR) value of the one or more second audio signals, the second portion of the second audio signal corresponding to the second time range; and generating a second portion of the third microphone audio data by subtracting a second portion of the one or more first audio signals from the second portion of the second audio signal, the second portion of the third microphone audio data and the second portion of the one or more first audio signals corresponding to the second time range.

3. The computer-implemented method of claim 1, wherein selecting the one or more first audio signals from the plurality of audio signals further comprises:

determining that, within the first time range, a first portion of the third audio signal has a highest signal-to-noise ratio (SNR) value of the plurality of audio signals, the first portion of the third audio signal corresponding to the first time range;

associating the third direction with the remote speech within the first time range; and selecting at least the third audio signal as the reference signal.

4. The computer-implemented method of claim 1, further comprising:

determining, by the double-talk detector, that a second portion of the first microphone audio data includes the first representation of the local speech but not the first representation of the remote speech, the second portion of the first microphone audio data corresponding to a second time range after the first time range;

determining, by a second detector of the local device, that the second portion of the first microphone audio data corresponds to a single audio source;

determining, by the second detector, that the single audio source is associated with the second direction; and associating the second direction with the local speech within the second time range.

5. A computer-implemented method, the method comprising:

receiving first audio data associated with at least a first microphone of a first device;

receiving second audio data associated with at least a second microphone of the first device;

determining, based on at least the first audio data and the second audio data, a plurality of audio signals comprising:

a first audio signal corresponding to a first direction, and a second audio signal corresponding to a second direction;

determining that a first portion of the first audio data includes a representation of first speech originating at the first device, the first portion of the first audio data corresponding to a first time range;

determining that the first audio signal and the second audio signal are not associated with a reference signal;

determining that, within the first time range, a first portion of the first audio signal has a highest signal quality metric value; and generating a first portion of third audio data by subtracting a first portion of the reference signal from the first portion of the first audio signal, the first portion of the third audio data and the first portion of the reference signal corresponding to the first time range.

6. The computer-implemented method of claim 5, further comprising:

receiving fourth audio data from a second device, the fourth audio data including a first representation of second speech originating at the second device; and sending the fourth audio data to at least one loudspeaker of the first device, wherein determining that the first audio signal and the second audio signal are not associated with the reference signal further comprises:

determining that a third audio signal of the plurality of audio signals includes a second representation of the second speech;

determining one or more audio signals from the plurality of audio signals that are associated with the reference signal, the one or more audio signals including the third audio signal; and determining that the first audio signal and the second audio signal are not included in the one or more audio signals.

7. The computer-implemented method of claim 5, wherein determining that the first audio signal has the highest signal quality metric value within the first time range further comprises:

determining a first energy value associated with the first portion of the first audio signal;

identifying one or more audio signals from the plurality of audio signals that are associated with the reference signal;

determining a second energy value associated with a first portion of the one or more audio signals, the first portion of the one or more audio signals corresponding to the first time range;

determining a first signal quality metric value associated with the first portion of the first audio signal by dividing the first energy value by the second energy value; and determining that, within the first time range, the first signal quality metric value is highest of a plurality of signal quality metric values.

8. The computer-implemented method of claim 5, further comprising:

determining that a second portion of the first audio data does not include the representation of the first speech, the second portion of the first audio data corresponding to a second time range after the first time range;

determining that, within the second time range, a portion of the second audio signal has a lowest signal quality metric value; and generating a second portion of the third audio data by subtracting a second portion of the reference signal from the portion of the second audio signal, the second portion of the third audio data and the second portion of the reference signal corresponding to the second time range.

9. The computer-implemented method of claim 5, further comprising:

determining that a second portion of the first audio data includes a second representation of the first speech and a representation of second speech originating at a second device, the second portion of the first audio data corresponding to a second time range after the first time range;

determining that, within the first time range, the first portion of the first audio signal had the highest signal quality metric value; and generating a second portion of the third audio data by subtracting a second portion of the reference signal from a second portion of the first audio signal, wherein the second portion of the third audio data, the second portion of the reference signal, and the second portion of the first audio signal correspond to the second time range.

10. The computer-implemented method of claim 5, further comprising:

determining that a second portion of the first audio data includes a second representation of the first speech and a representation of second speech originating at a second device, the second portion of the first audio data corresponding to a second time range after the first time range;

determining that, within the second time range, a portion of the second audio signal has a highest signal quality metric value; and generating a second portion of the third audio data by subtracting a second portion of the reference signal from the portion of the second audio signal, the second portion of the third audio data and the second portion of the reference signal corresponding to the second time range.

11. The computer-implemented method of claim 5, further comprising:

determining that a second portion of the first audio data does not include the representation of the first speech, the second portion of the first audio data corresponding to a second time range after the first time range;

determining that, within the second time range, a portion of a third audio signal of the plurality of audio signals has a highest signal quality metric value; and determining that the third audio signal is associated with the reference signal.

12. The computer-implemented method of claim 5, further comprising:

associating the first audio signal with the first speech within the first time range;

determining that a second portion of the first audio data includes a second representation of the first speech but does not include a representation of second speech originating at a second device, the second portion of the first audio data corresponding to a second time range after the first time range;

determining that, within the second time range, a portion of the second audio signal has a highest signal quality metric value; and associating the second audio signal with the first speech within the second time range.

13. The computer-implemented method of claim 5, further comprising:

determining that the single first portion of the first audio data corresponds to a single audio source;

determining that the single audio source is associated with the first direction; and associating the first direction with the first speech within the first time range.

14. The computer-implemented method of claim 5, further comprising:

determining that a second portion of the first audio data does not include the representation of the first speech, the second portion of the first audio data corresponding to a second time range after the first time range;

determining that the second portion of the first audio data corresponds to a single audio source;

determining that the single audio source is associated with a third direction; and associating the third direction with a loudspeaker associated with the first device within the second time range.

15. A computer-implemented method, the method comprising:

receiving first audio data associated with at least a first microphone of a first device;

receiving second audio data associated with at least a second microphone of the first device;

determining, based on at least the first audio data and the second audio data, a plurality of audio signals comprising:

a first audio signal corresponding to a first direction, and a second audio signal corresponding to a second direction;

determining that a first portion of the first audio data does not include a representation of first speech originating at the first device, the first portion of the first audio data corresponding to a first time range;

determining that the first audio signal and the second audio signal are not associated with a reference signal;

determining that, within the first time range, a first portion of the first audio signal has a lowest signal quality metric value; and generating a first portion of third audio data by subtracting a first portion of the reference signal from the first portion of the first audio signal, the first portion of the third audio data and the first portion of the reference signal corresponding to the first time range.

16. The computer-implemented method of claim 15, wherein determining that the first audio signal has the lowest signal quality metric value within the first time range further comprises:

determining a first energy value associated with the first portion of the first audio signal;

identifying one or more audio signals from the plurality of audio signals that are associated with the reference signal;

determining a second energy value associated with a first portion of the one or more audio signals, the first portion of the one or more audio signals corresponding to the first time range;

determining a first signal quality metric value associated with the first portion of the first audio signal by dividing the first energy value by the second energy value; and determining that, within the first time range, the first signal quality metric value is lowest of a plurality of signal quality metric values.

17. The computer-implemented method of claim 15, further comprising:

determining that a second portion of the first audio data includes the representation of the first speech, the second portion of the first audio data corresponding to a second time range after the first time range;

determining that, within the second time range, a portion of the second audio signal has a highest signal quality metric value; and generating a second portion of the third audio data by subtracting a second portion of the reference signal from the portion of the second audio signal, the second portion of the third audio data and the second portion of the reference signal corresponding to the second time range.

18. The computer-implemented method of claim 15, further comprising:

determining that a second portion of the first audio data does not include the representation of the first speech, the second portion of the first audio data corresponding to a second time range after the first time range;

determining that, within the second time range, a portion of a third audio signal of the plurality of audio signals has a highest signal quality metric value; and determining that the third audio signal is associated with the reference signal.

19. The computer-implemented method of claim 5, further comprising:

determining that a second portion of the first audio data includes a second representation of the first speech but does not include a representation of second speech originating at a second device, the second portion of the first audio data corresponding to a second time range after the first time range;

determining that, within the second time range, a portion of the second audio signal has a highest signal quality metric value; and associating the second audio signal with the first speech within the second time range.

20. The computer-implemented method of claim 5, further comprising:

determining that the first portion of the first audio data corresponds to a single audio source;

determining that the single audio source is associated with a third direction; and associating the third direction with a loudspeaker associated with the first device within the first time range.

* * * * *